US010800061B2

(12) United States Patent
Yamamuro et al.

(10) Patent No.: US 10,800,061 B2
(45) Date of Patent: Oct. 13, 2020

(54) SLOTTER DEVICE, SHEET SLICING METHOD, AND CARTON FORMER

(71) Applicant: MITSUBISHI HEAVY INDUSTRIES MACHINERY SYSTEMS, LTD., Hyogo (JP)

(72) Inventors: Kunihiko Yamamuro, Mihara (JP); Kazuya Sugimoto, Mihara (JP); Osamu Hatano, Mihara (JP)

(73) Assignee: MITSUBISHI HEAVY INDUSTRIES MACHINERY SYSTEMS, LTD., Hyogo (JP)

( * ) Notice: Subject to any disclaimer, the term of this patent is extended or adjusted under 35 U.S.C. 154(b) by 192 days.

(21) Appl. No.: 15/551,034

(22) PCT Filed: Sep. 2, 2015

(86) PCT No.: PCT/JP2015/074954
§ 371 (c)(1),
(2) Date: Aug. 14, 2017

(87) PCT Pub. No.: WO2016/132576
PCT Pub. Date: Aug. 25, 2016

(65) Prior Publication Data

US 2018/0029244 A1 Feb. 1, 2018

(30) Foreign Application Priority Data

Feb. 17, 2015 (JP) ..... 2015-028901

(51) Int. Cl.
*B26D 1/28* (2006.01)
*B26D 3/06* (2006.01)
(Continued)

(52) U.S. Cl.
CPC ..... *B26D 1/28* (2013.01); *B26D 1/285* (2013.01); *B26D 1/40* (2013.01); *B26D 1/405* (2013.01);
(Continued)

(58) Field of Classification Search
CPC ..... Y10T 83/4798; Y10T 83/9391; Y10T 83/9469; Y10T 83/9403; Y10T 83/9399;
(Continued)

(56) References Cited

U.S. PATENT DOCUMENTS 1,567,656 A * 12/1925 Langston ..... B26D 3/14 493/355
2,808,106 A 10/1957 Belton
(Continued)

FOREIGN PATENT DOCUMENTS

CN 101873926 A 10/2010
CN 102529158 A 7/2012
(Continued)

OTHER PUBLICATIONS

English Translation JP2003-001727A ; Minami, Jiro; B31B001/22.*
(Continued)

*Primary Examiner* — Laura M Lee
(74) *Attorney, Agent, or Firm* — Hauptman Ham, LLP

(57) ABSTRACT

The versatility of a slotter device, a sheet slicing method and a carton former is improved by providing first slotter heads and first lower blades, first slotter knives and second slotter knives mounted on the circumferences of the first slotter heads, second slotter heads and second lower blades, third slotter knives and fourth slotter knives mounted on the circumferences of the second slotter heads, third slotter heads and third lower blades, and fifth slotter knives and
(Continued)

sixth slotter knives mounted on the circumferences of the third slotter heads, to process cuts of differing lengths.

8 Claims, 9 Drawing Sheets

(51) Int. Cl.

| | |
|---|---|
| ***B26F 1/38*** | (2006.01) |
| ***B31B 50/14*** | (2017.01) |
| ***B26D 1/40*** | (2006.01) |
| ***B31B 50/22*** | (2017.01) |
| ***B31B 100/00*** | (2017.01) |
| ***B31B 120/30*** | (2017.01) |
| ***B31B 50/00*** | (2017.01) |
| ***B26D 3/08*** | (2006.01) |

(52) U.S. Cl.
CPC ..... *B26D 3/06* (2013.01); *B26F 1/384* (2013.01); *B31B 50/00* (2017.08); *B31B 50/146* (2017.08); *B31B 50/22* (2017.08); *B26D 3/085* (2013.01); *B31B 2100/0022* (2017.08); *Y10T 83/4798* (2015.04); *Y10T 83/9391* (2015.04)

(58) Field of Classification Search
CPC ..... Y10T 83/9401; Y10T 83/9396; Y10S 83/917; B31B 50/20; B31B 50/22; B26F 1/20; B26F 1/384; B26D 7/2642; B26D 3/14
USPC ..... 83/332, 671, 917, 673–677, 698.51; 493/365, 370, 368, 56, 361–362
See application file for complete search history.

(56) References Cited

U.S. PATENT DOCUMENTS

| | | | | | |
|---|---|---|---|---|---|
| 3,036,486 | A * | 5/1962 | Wilcox | B26D 1/0006 | 83/500 |
| 3,211,066 | A * | 10/1965 | Palamenti | B26D 1/0006 | 493/365 |
| 3,236,137 | A * | 2/1966 | Young | B26D 1/0006 | 83/671 |
| 3,518,922 | A * | 7/1970 | Kuehn | B26D 7/1818 | 493/365 |
| 3,575,091 | A * | 4/1971 | LaBantschnig | B26D 3/14 | 493/365 |
| 3,772,953 | A * | 11/1973 | Sullivan | B26D 7/2642 | 83/332 |
| 4,003,300 | A * | 1/1977 | Grobman | B26D 7/2642 | 493/365 |
| 4,061,063 | A * | 12/1977 | Brush | B23D 19/065 | 83/55 |
| 4,167,884 | A * | 9/1979 | Santanna | B26D 1/0006 | 493/365 |
| 4,643,060 | A * | 2/1987 | Fremion | B26D 7/10 | 83/169 |
| 5,144,874 | A * | 9/1992 | Garrett | B26D 1/0006 | 83/332 |
| 5,174,184 | A * | 12/1992 | Meeks | B26D 7/2621 | 83/332 |
| 5,181,899 | A * | 1/1993 | Hill | B26D 7/2642 | 493/34 |
| 5,316,538 | A * | 5/1994 | Hill | B26D 7/2642 | 493/355 |
| 7,044,040 | B1 * | 5/2006 | Smith | B26D 7/1818 | 493/342 |
| 7,631,586 | B2 * | 12/2009 | Agata | B26D 7/2642 | 493/365 |
| 8,579,777 | B2 | 11/2013 | Hatano et al. | | |
| 2006/0156891 | A1 * | 7/2006 | Agata | B26D 7/2642 | 83/671 |
| 2009/0062098 | A1 | 3/2009 | Inoue et al. | | |
| 2011/0092351 | A1 | 4/2011 | Hatano et al. | | |
| 2013/0184133 | A1 | 7/2013 | Sugimoto et al. | | |
| 2013/0296151 | A1 | 11/2013 | Hatano et al. | | |

FOREIGN PATENT DOCUMENTS

| | | | |
|---|---|---|---|
| CN | 202911193 | U | 5/2013 |
| CN | 103269849 | A | 8/2013 |
| CN | 203666014 | U | 6/2014 |
| JP | 2000-313073 | A | 11/2000 |
| JP | 3197256 | B2 | 8/2001 |
| JP | 2002-67190 | A | 3/2002 |
| JP | 2003-1727 | A | 1/2003 |
| JP | 2003-251713 | A | 9/2003 |
| JP | 2009-291992 | A | 12/2009 |
| JP | 2010142988 | A | 7/2010 |
| JP | 2013-169687 | A | 9/2013 |
| JP | 2015027740 | A | 2/2015 |
| KR | 20130059457 | A | 6/2013 |

OTHER PUBLICATIONS

Office Action in Japanese Application No. 2015-028901, dated Jul. 3, 2018, 5pp.
International Search Report in International Application No. PCT/JP2015/074954, dated Oct. 13, 2015.
Written Opinion in International Application No. PCT/JP2015/074954, dated Oct. 13, 2015.
Office Action for Japanese Application No. 2015-028901 dated Jan. 29, 2019; 5pp.
Office Action for Korean Application No. 10-2017-7022685 dated Apr. 5, 2019; 10pp.
Extended European Search Report for European Application No. 15882677 dated Nov. 29, 2018; 7pp.
Office Action in CN Application No. 201580076184.2, dated Jul. 11, 2018, 10pp.

* cited by examiner

SLOTTER DEVICE, SHEET SLICING METHOD, AND CARTON FORMER

RELATED APPLICATIONS

The present application is a National Stage of PCT International Application Number PCT/JP2015/074954, filed Sep. 2, 2015 which claims the benefit of priority from Japanese Patent Application Number 2015-028901, filed Feb. 17, 2015.

TECHNICAL FIELD

The present invention relates to a slotter device and a sheet slicing method in which slicing is performed in a process of manufacturing a corrugated carton, and a carton former having a slotter device.

BACKGROUND ART

A general carton former manufactures a carton body (corrugated carton) by processing a sheet material (for example, a corrugated fiberboard), and includes a sheet feeding section, a printing section, a slotter creaser section, a die-cut section, a folding section, and counter-ejector section. The corrugated fiberboards stacked on a table are fed to the printing section one by one at a constant speed by the sheet feeding section. The printing section includes a printing unit and performs printing on the corrugated fiberboard. The slotter creaser section forms creasing lines which become folding lines on the printed corrugated fiberboard and performs processing of grooves becoming flaps or gluing margin strips for joining. The die-cut section performs drilling for hand hole on the corrugated fiberboard on which the creasing lines, the grooves, and gluing margin strips are formed. The folding section applies glue to the gluing margin strip and folds the corrugated fiberboard on which the creasing lines, the grooves, the gluing margin strips, and the hand holes are formed along the creasing lines while moving the corrugated fiberboard, and joins the gluing margin strips to each other to manufacture a flat corrugated carton. In addition, the counter-ejector section stacks the corrugated cartons in which corrugated fiberboards are folded and glued, sorts the stacked corrugated cartons into a predetermined number of batches, and discharges the sorted corrugated cartons.

Meanwhile, in a case where a small corrugated carton is manufactured, considering workability of the small corrugated carton, printing, after creasing line processing, processing of grooves and gluing margin strips, drilling, or the like is performed in a state where several corrugated fiberboards are connected to each other, the corrugated fiberboard is divided into several corrugated fiberboards, and each corrugated fiberboard is folded to manufacture the corrugated carton. In this case, lengths of the grooves or the gluing margin strips are different from each other according to the size or shape of the corrugated fiberboard. The length of each of the grooves or the gluing margin strips of the corrugated fiberboard is set by a circumferential length of a slotter knife mounted on a slotter head. Accordingly, in the slotter creaser section of the related art, the slotter knife mounted on the slotter head is replaced with other slotter knives according to the lengths of the grooves or the gluing margin strips.

Replacing the slotter knife of the slotter head according to the lengths of the grooves or the gluing margin strips is a difficult work requiring a long time, and thereby, productivity decreases. In order to solve the above-described problems, for example, PTL 1 is suggested. In slotters of a carton former of a corrugated fiberboard described in PTL 1, several slotters are provided, and phases of slotter knives of the slotters are adjusted.

CITATION LIST

Patent Literature

[PTL 1] Japanese Unexamined Patent Application Publication No. 2002-067190

SUMMARY OF INVENTION

Technical Problem

As described above, in the corrugated fiberboards, since the sizes of the flaps or the gluing margin strips are different according to the sizes or the shapes of the corrugated fiberboards, lengths of grooves or cut end portions processed by the die-cut section varies widely. Accordingly, it is preferable to develop a device in which grooves or cut end portions having lengths different from each other can be processed by one device.

The present invention is made to solve the above-described problems, and an object thereof is to provide a slotter device, a sheet slicing method, and a carton former in which cut portions having lengths different from each other are processed to increase versatility.

Solution to Problem

In order to achieve the above-described object, there is provided a slotter device, including: a first upper slotter head and a first lower slotter head which are supported so as to be rotatable relative to each other and perform slicing of a sheet; a first slotter knife and a second slotter knife which are mounted on an outer peripheral portion of any one of the first upper slotter head and the first lower slotter head; a second upper slotter head and a second lower slotter head which are supported so as to be rotatable relative to each other and perform the slicing of the sheet; a third slotter knife and a fourth slotter knife which are mounted on an outer peripheral portion of any one of the second upper slotter head and the second lower slotter head; a third upper slotter head and a third lower slotter head which are supported so as to be rotatable relative to each other and perform the slicing of the sheet; and a fifth slotter knife and a sixth slotter knife which are mounted on an outer peripheral portion of any one of the third upper slotter head and the third lower slotter head.

Accordingly, since three slotter heads are juxtaposed in the transport direction of the corrugated fiberboard and two slotter knives are provided on each slotter head, when a corrugated fiberboard having several sheets connected to each other in the length in the transport direction is manufactured, it is possible to perform slicing or gluing margin strip processing, and in this case, it is possible to easily adjust the lengths of grooves or gluing margin strips to be processed by combining the several slotter knives, cut portions having lengths different from each other can be processed, and it is possible to improve versatility.

In the slotter device of the present invention, the first slotter knife and the sixth slotter knife can form an opening groove on each end portion of the sheet in a transport direction, and the second slotter knife, the third slotter knife, the fourth slotter knife, and the fifth slotter knife can form a communication groove on an intermediate portion of the sheet in the transport direction.

Accordingly, since the first and sixth slotter knives form opening grooves on the end portions of the sheet and the second, third, fourth, fifth slotter knives form communication grooves at the intermediate portion of the sheet, it is possible to easily form the cut portions having lengths different from each other by selecting a slotter knife to be used among the second, third, fourth, and fifth slotter knives.

In the slotter device of the present invention, a circumferential length of each of the first slotter knife and the sixth slotter knife is set to be longer than a circumferential length of each of the second slotter knife and the fifth slotter knife.

Accordingly, it is possible to form an opening groove having a predetermined length on each end portion of the sheet using only the first and sixth slotter knives by lengthening the circumferential lengths of the first and sixth slotter knives, and by shortening the circumferential lengths of the second and fifth slotter knives, it is possible to form the communication groove having a desired length by combining the four slotter knives.

In the slotter device of the present invention, a circumferential length of the third slotter knife is set to be longer than a circumferential length of the fourth slotter knife.

Accordingly, it is possible to easily form the communication groove having a desired length by providing the slotter knives having the circumferential lengths different from each other on the second slotter head.

In the slotter device of the present invention, the circumferential length of each of the second slotter knife and the fifth slotter knife is set to be shorter than the circumferential length of the third slotter knife and to be longer than the circumferential length of the fourth slotter knife.

Accordingly, by setting the circumferential lengths of the second, third, fourth, and fifth slotter knives to be different from each other, it is possible to easily form the communication groove having a desired length by combining the four slotter knives.

In the slotter device of the present invention, each of the second slotter knife, the third slotter knife, and the sixth slotter knife is fixed to the slotter head, and each of the first slotter knife, the fourth slotter knife, and the fifth slotter knife is mounted on the slotter head so as to be adjustable in position in a circumferential direction.

Accordingly, by fixing one slotter knife and allowing the position of the other slotter knife to be adjustable in a slotter head, it is possible to easily adjust the circumferential lengths of the several combined slotter knives by moving the other slotter knife based on the fixed one slotter knife.

In the slotter device of the present invention, a drive device individually rotating the slotter head is connected to the slotter head on which the slotter knife is mounted.

Accordingly, since the slotter heads can be rotated individually, it is possible to easily form the communication groove having a desired length by stopping the slotter head on which an unused slotter knife is mounted.

In the slotter device of the present invention, a transport unit is provided between the first upper slotter head and the first lower slotter head, between the second upper slotter head and the second lower slotter head, and between the third upper slotter head and the third lower slotter head.

Accordingly, since the transport unit is provided between the slotter heads, even when a sheet which is short in the transport direction is provided, it is possible to appropriately transport the sheet so as to process the sheet, and it is possible to improve reliability.

Moreover, according to the present invention, there is provided a sheet slicing method of performing slicing of a corrugated fiberboard having several sheets connected to each other in a length in a transport direction of the corrugated fiberboard by a first slotter head, a second slotter head, and a third slotter head juxtaposed in the transport direction of the corrugated fiberboard, the method including: a step of forming a first opening groove on one end portion of the corrugated fiberboard in the transport direction by a first slotter knife mounted on the first slotter head; a step of forming a communication groove on an intermediate portion of the corrugated fiberboard in the transport direction by at least two slotter knives of a second slotter knife mounted on the first slotter head, a third slotter knife and a fourth slotter knife mounted on the second slotter head, and a fifth slotter knife mounted on the third slotter head; and a step of forming a second opening groove on the other end portion of the corrugated fiberboard in the transport direction by a sixth slotter knife mounted on the third slotter head.

Accordingly, it is possible to easily adjust the lengths of grooves or gluing margin strips to be processed by combining the several slotter knives, cut portions having lengths different from each other can be processed, and it is possible to improve versatility.

In the sheet slicing method of the present invention, when slicing is performed on a corrugated fiberboard having one sheet in the length in the transport direction, the second slotter head is stopped, the first opening groove is formed by at least one slotter knife of the first slotter head, and the second opening groove is formed by at least one slotter knife of the third slotter head.

Accordingly, even when the corrugated fiberboard having one sheet is provided, it is possible to easily form the opening groove having a desired length by stopping the unused second slotter head.

Moreover, according to the present invention, there is provided A carton former, including: a sheeting feeding section which supplies a sheet; a printing section which performs printing on the sheet; a slotter creaser section having the slotter device which performs creasing line processing and slicing on the printed sheet; a cutting section which cuts the sheet subjected to the creasing line processing and the slicing at an intermediate position of the sheet in a transport direction; a folding section which folds the cut sheet and joins an end portion of the sheet to form a carton body; and a counter-ejector section which stacks the carton bodies while counting the carton bodies, and thereafter, discharges the carton bodies for each predetermined number.

Accordingly, in the printing section, printing is performed on the sheet supplied from the sheet feeding section, and in the slotter creaser section, creasing line processing and slicing are performed on the sheet. Moreover, in the folding section, the sheet is folded, the end portions are joined to each other, and the carton body is formed. In addition, in the counter-ejector section, the carton bodies are stacked while being counted. In this case, in the slotter device, it is possible to easily adjust the lengths of the grooves or the gluing margin strips to be processed by combining the several slotter knives, it is possible to process the cut portions having lengths different from each other, and thereby, it is possible to improve versatility.

Advantageous Effects of Invention

According to the slotter device, the sheet slicing method, and the carton former of the present invention, since three slotter heads are juxtaposed in the transport direction of the corrugated fiberboard and two slotter knives are provided on each slotter head, it is possible to process the cut portions having lengths different from each other, and thereby, it is possible to improve versatility.

DESCRIPTION OF EMBODIMENTS

Preferred embodiments of a slotter device, a sheet slicing method, and a carton former according to the present invention will be described in detail with reference to the accompanying drawings. In addition, the present invention is not limited by the embodiment, and in a case where several embodiments are provided, the present invention includes those which are obtained by combining the embodiments.

Figure 1:
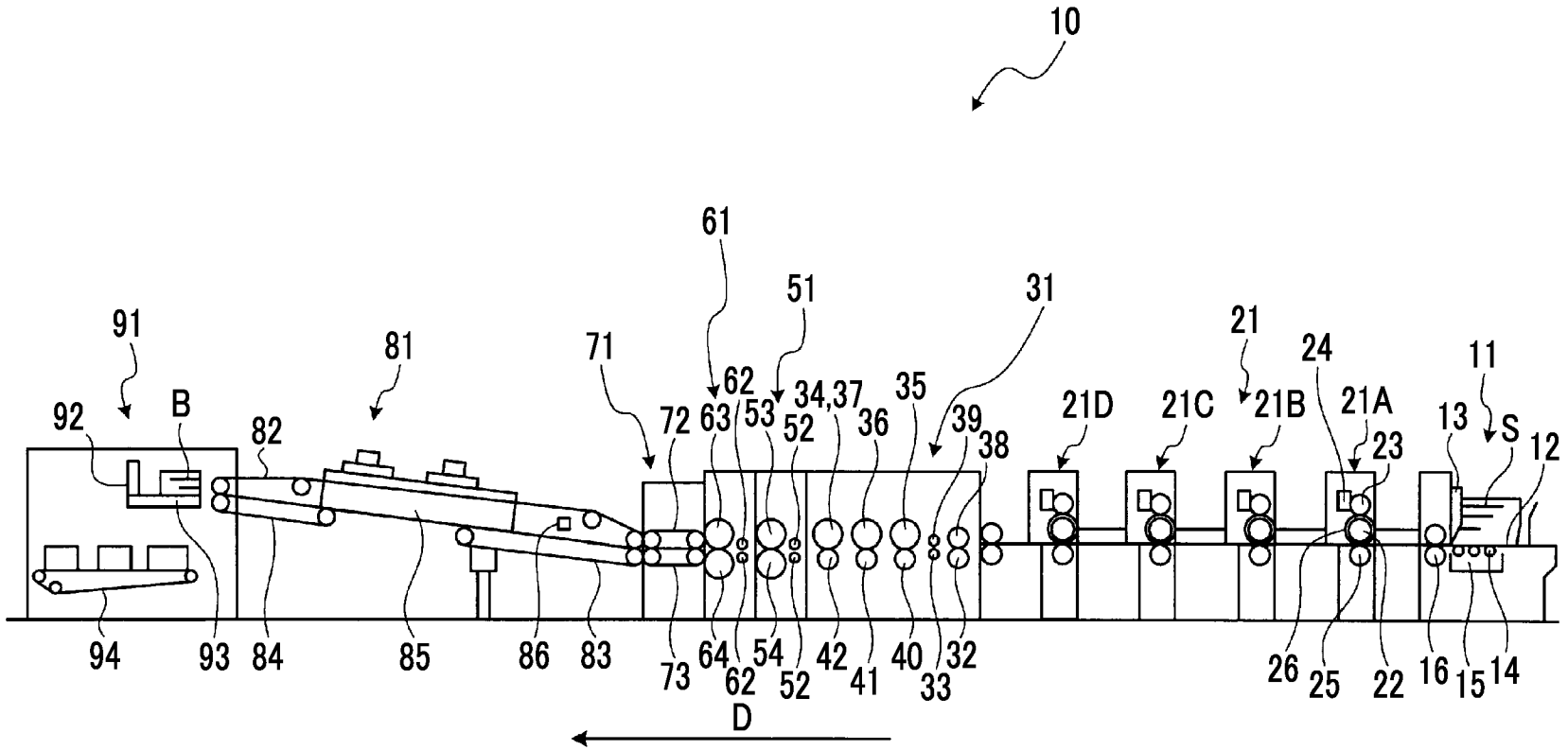
FIG. 1 is a schematic configuration view showing a carton former of the present embodiment.

FIG. 1 is a schematic configuration view showing a carton former of the present embodiment.

In the present embodiment, as shown in FIG. 1, a carton former 10 manufactures a corrugated carton (carton body) B by processing a corrugated fiberboard S. The carton former 10 includes a sheet feeding section 11, a printing section 21, a slotter creaser section 31, a die-cut section 51, a cutting section 61, a speed-increasing section 71, a folding section 81, and a counter-ejector section 91 which are linearly disposed in a direction D in which the corrugated fiberboard S and the corrugated carton B are transported.

In the sheet feeding section 11, the corrugated fiberboards S are fed to the printing section 21 one by one at a constant speed. The sheet feeding section 11 includes a table 12, a front stopper 13, a supply roller 14, a suction unit 15, and a feed roll 16. Several corrugated fiberboards S are placed on the table 12 so as to be stacked, and the table 12 is supported so as to be lifted and lowered. The front stopper 13 can position the front end position of each of the corrugated fiberboards S stacked on the table 12, and a gap which allows one corrugated fiberboard S to pass through a portion between the lower end portion of the front stopper 13 and the table 12 is secured. Several supply rollers 14 are disposed corresponding to the table 12 in the transport direction D of the corrugated fiberboard S. When the table 12 is lowered, the corrugated fiberboard S located at the lowermost position among several stacked corrugated fiberboards S can be fed forward by the supply rollers 14. The stacked corrugated fiberboards S are suctioned downward, that is, toward the table 12 side or the supply roller 14 side by the suction unit 15. The feed roll 16 can provide the corrugated fiberboard S fed by the supply rollers 14 to the printing section 21.

The printing section 21 performs multi-color printing (in the present embodiment, four-color printing) on the surface of the corrugated fiberboard S. In the printing section 21, four printing units 21A, 21B, 21C, and 21D are disposed in series, and printing can be performed on the surface of the corrugated fiberboard S using four ink colors. The printing units 21A, 21B, 21C, and 21D are approximately similarly configured to each other, and each of the printing units 21A, 21B, 21C, and 21D includes a printing cylinder 22, an ink supply roll (anilox roll) 23, an ink chamber 24, and a receiving roll 25. A printing die 26 is mounted on the outer peripheral portion of the printing cylinder 22, and the printing cylinder 22 is rotatably provided. The ink supply roll 23 is disposed so as to contact against the printing die 26 in the vicinity of the printing cylinder 22, and is rotatably provided. The ink chamber 24 stores ink and is provided in the vicinity of the ink supply roll 23. The corrugated fiberboard S is interposed between the receiving roll 25 and the printing cylinder 22, the receiving roll 25 transports the corrugated fiberboard S while applying a predetermined printing pressure to the corrugated fiberboard S, and the receiving roll 25 is rotatably provided so as to face the lower portion of the printing cylinder 22. In addition, although not shown, a pair of upper and lower feed rolls is provided before and after each of the printing units 21A, 21B, 21C, and 21D.

The slotter creaser section 31 includes a slotter device 100 (refer to FIG. 2) and performs creasing line processing, cutting, slicing, and gluing margin strip processing on the corrugated fiberboard S. The slotter creaser section 31 includes first creasing line rolls 32, second creasing line rolls 33, a slitter head 34, first slotter heads 35, second slotter heads 36, and third slotter heads 37.

The first creasing line rolls 32 are cylindrically formed, and several first (four in the present embodiment) creasing lines rolls 32 are disposed at predetermined intervals in a horizontal direction orthogonal to the transport direction D of the corrugated fiberboard S. The second creasing line rolls 33 are cylindrically formed, and several second (four in the present embodiment) creasing lines rolls 33 are disposed at predetermined intervals in the horizontal direction orthogonal to the transport direction D of the corrugated fiberboard S. The first creasing line rolls 32 disposed below perform the creasing line processing on a rear surface (lower surface) of the corrugated fiberboard S, and similarly the first creasing line rolls 32, the second creasing line rolls 33 disposed below perform the creasing line processing on the rear surface (lower surface) of the corrugated fiberboard S. Receiving rolls 38 and 39 are provided at upper positions facing the creasing line rolls 32 and 33 so as to be rotatable in synchronization with the creasing line rolls 32 and 33.

The first slotter heads 35 are cylindrically formed, and first several (four in the present embodiment) slotter heads 35 are disposed at predetermined intervals in the horizontal direction orthogonal to the transport direction D of the corrugated fiberboard S. The first slotter heads 35 are provided to correspond to predetermined positions of the transported corrugated fiberboard S in the width direction and perform slicing and gluing margin strip processing at the predetermined positions of the corrugated fiberboard S. The second slotter heads 36 are cylindrically formed, and second several (four in the present embodiment) slotter heads 36 are disposed at predetermined intervals in the horizontal direction orthogonal to the transport direction D of the corrugated fiberboard S. The second slotter heads 36 are provided to correspond to predetermined positions of the transported corrugated fiberboard S in the width direction and perform slicing and gluing margin strip processing at the predetermined positions of the corrugated fiberboard S.

Each of the slitter head 34 and the third slotter heads 37 is cylindrically formed, and several (five in the present embodiment) heads which are one slitter head 34 and four third slotter heads 37 are disposed at predetermined intervals in the horizontal direction orthogonal to the transport direction D of the corrugated fiberboard S. One slitter head 34 is configured, is provided to correspond to the end portion of the transported corrugated fiberboard S in the width direction, and can cut the end portion of the corrugated fiberboard S in the width direction. Four third slotter heads 37 are configured, are provided to correspond to predetermined positions of the transported corrugated fiberboard S in the width direction, and can perform slicing and gluing margin strip processing at predetermined positions of the corrugated fiberboard S. Lower blades 40 are provided at lower positions facing the first slotter heads 35 so as to be rotatable in synchronization with the first slotter heads 35, lower blades 41 are provided at lower positions facing the second slotter heads 36 so as to be rotatable in synchronization with the second slotter heads 36, and lower blades 42 are provided at lower positions facing the slitter head 34 and the third slotter heads 37 so as to be rotatable in synchronization with the slitter head 34 and the third slotter heads 37.

In the die-cut section 51, drilling for forming a hand hole is performed on the corrugated fiberboard S. The die-cut section 51 includes a pair of upper and lower feed pieces 52, an anvil cylinder 53, and a knife cylinder 54. The feed pieces 52 are rotatably provided such that the corrugated fiberboard S is transported in a state where the corrugated fiberboard S is interposed between the upper portion and the lower portion. Each of the anvil cylinder 53 and the knife cylinder 54 is cylindrically formed, and the anvil cylinder 53 and the knife cylinder 54 are rotatable in synchronization with each other by a drive device (not shown). In this case, a head and a die are provided at a predetermined position on the outer peripheral portion of the knife cylinder 54 while an anvil is formed on the outer peripheral portion of the anvil cylinder 53.

The corrugated fiberboard S is cut to be two corrugated fiberboards at an intermediate position in the transport direction D by the cutting section 61. The cutting section 61 includes a pair of upper and lower feed pieces 62 and a pair of upper and lower cutting rolls 63 and 64. The feed pieces 62 are rotatably provided such that the corrugated fiberboard S is transported in a state where the corrugated fiberboard S is interposed between the upper portion and the lower portion. Each of the cutting rolls 63 and 64 is cylindrically formed, and the cutting rolls 63 and 64 are rotatable in synchronization with each other by a drive device (not shown). A cutting blade is fixed to each of the cutting rolls 63 and 64 at a predetermined position of the outer peripheral portion of each of the cutting rolls 63 and 64.

The speed-increasing section 71 increases a speed of the cut corrugated fiberboard S, and a predetermined transport interval between the transported corrugated fiberboards S is secured by the speed-increasing section 71. The speed-increasing section 71 includes a pair of upper and lower transport belts 72 and 73. The transport belts 72 and 73 can be rotated by a drive device (not shown) in synchronization with the drive device such that the corrugated fiberboard S is transported in a state where the corrugated fiberboard S is interposed between the upper portion and the lower portion. The transport speed of the corrugated fiberboard S in the speed-increasing section 71 is set to a faster speed than the transport speed of the corrugated fiberboard S until the cutting section 61.

In the folding section 81, the corrugated fiberboard S is folded while moving in the transport direction D, and both end portions of the corrugated fiberboard S in the width direction are joined to each other so as to form a flat corrugated carton B. The folding section 81 includes an upper transport belt 82, lower transport belts 83 and 84, and a forming device 85. The upper transport belt 82 and the lower transport belts 83 and 84 transport the corrugated fiberboard S and the corrugated carton B in a state of being interposed between the upper portion and the lower portion. The forming device 85 includes a pair of right and left forming belts, and end portions of the corrugated fiberboard S in the width direction is folded while being bent downward by the forming belts. In addition, the folding section 81 includes a gluing device 86. The gluing device 86 includes a glue gun, glue is ejected at a predetermined timing by the glue gun, and gluing can be applied to a predetermined position of the corrugated fiberboard S.

In the counter-ejector section 91, after the corrugated cartons B are stacked while being counted, the corrugated cartons B are sorted into a predetermined number of batches, and thereafter, the sorted corrugated cartons B are discharged. The counter-ejector section 91 includes a hopper device 92. The hopper device 92 includes an elevator 93 on which corrugated cartons B are stacked and which can be lifted and lowered, and a front stopper and an angle arrangement plate are provided in the elevator 93. In addition, an ejection conveyor 94 is provided below the hopper device 92.

Figure 13:
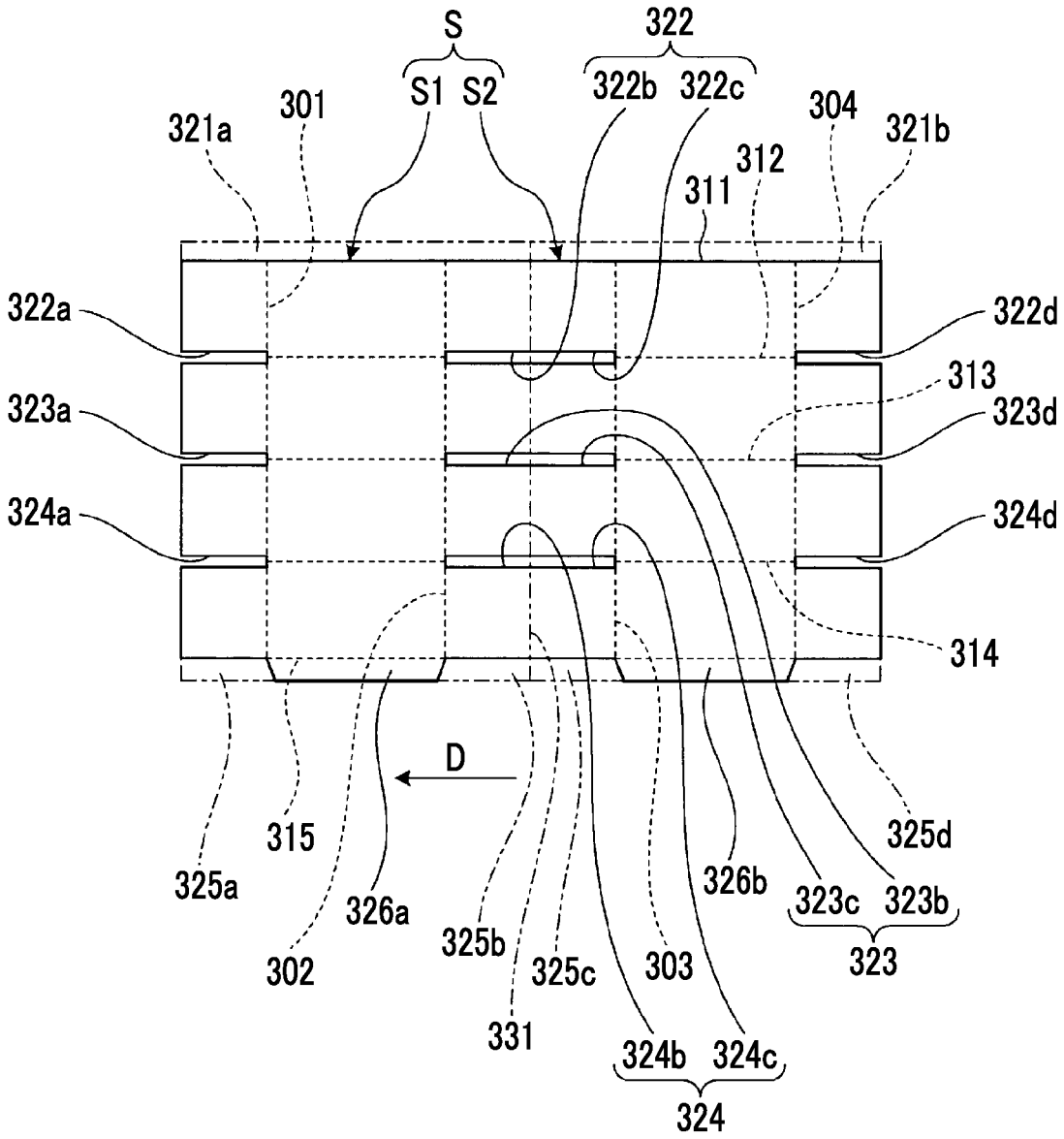
FIG. 13 is a plan view showing the twin box sheet.

Here, in the carton former of the above-described present embodiment, an operation for manufacturing the corrugated carton B from the corrugated fiberboard S is described. In the carton former of the present embodiment, printing, after creasing line processing, processing of grooves and gluing margin strips, and drilling are performed on two corrugated fiberboards S (S1 and S2) in a state where the two corrugated fiberboards S are connected to each other, the corrugated fiberboard is cut to be the two corrugated fiberboards S1 and S2, and the corrugated fiberboards S1 and S2 are folded so as to manufacture the corrugated carton B. FIG. 13 is a plan view showing a twin box sheet.

The corrugated fiberboard (twin box sheet) S is formed by gluing a corrugating core forming a waveform between a front liner and a rear liner. As shown in FIG. 13, in the corrugated fiberboard S, four folding lines 301, 302, 303, and 304 are formed in the pre-process of the carton former 10. The folding lines 301, 302, 303, and 304 are used for folding a flap when the corrugated carton B manufactured by the carton former 10 is assembled later. As shown in FIG. 1, the corrugated fiberboard S is stacked on the table 12 of the sheet feeding section 11.

In the sheet feeding section 11, first, several corrugated fiberboards S stacked on the table 12 are positioned by the front stopper 13, and thereafter, the table 12 is lowered, the corrugated fiberboard S positioned at the lowermost position is fed by several supply rollers 14. Accordingly, the corrugated fiberboard S is supplied to the printing section 21 on a predetermined velocity by the pair of feed rolls 16.

In the printing section 21, ink is supplied from the ink chamber 24 to the surface of the ink supply roll 23 in each of the printing units 21A, 21B, 21C, and 21D, and if the printing cylinder 22 and the ink supply roll 23 rotate, the ink on the surface of the ink supply roll 23 is transferred to the printing die 26. If the corrugated fiberboard S is transported to a portion between the printing cylinder 22 and the receiving roll 25, the corrugated fiberboard S is interposed between the printing die 26 and the receiving roll 25, and a printing pressure is applied to the corrugated fiberboard S so as to perform printing on the surface of the corrugated fiberboard S. The printed corrugated fiberboard S is transported to the slotter creaser section 31 by the feed rolls.

In the slotter creaser section 31, first, when the corrugated fiberboard S passes through the first creasing line rolls 32, as shown in FIG. 13, creasing lines 312, 313, 314, and 315 are formed on the rear surface (rear liner) side of the corrugated fiberboard S. In addition, when the corrugated fiberboard S passes through the second creasing line rolls 33, similarly to the first creasing line rolls 32, the creasing lines 312, 313, 314, and 315 are formed on the rear surface (rear liner) side of the corrugated fiberboard S again.

Next, when the corrugated fiberboard S in which the creasing lines 312, 313, 314, and 315 are formed passes through the slitter head 34, end portions 321*a* and 321*b* are cut at the position of a cutting position 311. In addition, when the corrugated fiberboard S passes through the first, second, and third slotter heads 35, 36, and 37, grooves 322*a*, 322*b*, 322*c*, 322*d*, 323*a*, 323*b*, 323*c*, 323*d*, 324*a*, 324*b*, 324*c*, and 324*d* are formed at the positions of the creasing lines 312, 313, and 314. In this case, end portions 325*a*, 325*b*, 325*c*, and 325*d* are cut at the position of the creasing line 315, and gluing margin strips 326*a* and 326*b* are formed.

Moreover, although it is described later, the grooves 322*d*, 323*d*, and 324*d* are formed when the corrugated fiberboard S passes through the first slotter heads 35, the grooves 322*a*, 323*a*, and 324*a* are formed, when the corrugated fiberboard S passes through the third slotter heads 37, and the grooves 322*b*, 322*c*, 323*b*, 323*c*, 324*b*, and 324*c* when the corrugated fiberboard S passes through the first, second, and third slotter heads 35, 36, and 37 stepwise. The grooves 322*b*, 322*c*, 323*b*, 323*c*, 324*b*, and 324*c* are communication grooves 322, 323, and 324, and the grooves 322*a*, 322*d*, 323*a*, 323*d*, 324*a*, and 324*d* are opening grooves. Thereafter, as shown in FIG. 1, the corrugated fiberboard S is transported to the die-cut section 51.

In the die-cut section 51, when the corrugated fiberboard S passes through a portion between the anvil cylinder 53 and the knife cylinder 54, a hand hole (not shown) is formed. However, since the hand hole processing is appropriately performed according to the kind of the corrugated fiberboard S, when the hand hole is not required, a blade attachment base (punching blade) for performing the hand hole processing is removed from the knife cylinder 54, and the corrugated fiberboard S passes through a portion between the rotating anvil cylinder 53 and knife cylinder 54. In addition, the corrugated fiberboard S in which the hand hole is formed is transported to the cutting section 61.

In the cutting section 61, when the corrugated fiberboard S passes through a portion between the upper and lower cutting rolls 63 and 64, as shown in FIG. 13, the corrugated fiberboard S is cut at a cutting position 331. Accordingly, the corrugated fiberboard S is cut to be the corrugated fiberboard S1 in which the grooves 322*a*, 322*b*, 323*a*, 323*b*, 324*a*, and 324*b* and the gluing margin strip 326*a* are formed, and the corrugated fiberboard S2 in which the grooves 322*c*, 322*d*, 323*c*, 323*d*, 324*c*, and 324*d* and the gluing margin strip 326*b* are formed. In addition, as shown in FIG. 1, the corrugated fiberboards S1 and S2 are sequentially transported to the speed-increasing section 71.

In the speed-increasing section 71, the cut corrugated fiberboards S1 and S2 are transported while being interposed between the upper and lower transport belts 72 and 73. In this case, since the corrugated fiberboards S1 and S2 are transported at a transport speed which is increased from the transport speed of the cutting section 61, a predetermined transport interval is formed between the corrugated fiberboards S1 and S2. Thereafter, the corrugated fiberboard S is transported to the folding section 81.

In the folding section 81, glue is applied to the gluing margin strip 326*a* (326*b*) by the gluing device 86 while the corrugated fiberboard S1 (S2) is moved in the transport direction D by the upper transport belt 82 and the lower transport belts 83 and 84, and thereafter, the corrugated fiberboards S1 (S2) is folded downward by the forming device 85 with the creasing lines 312 and 314 as base points. If this folding advances to nearly 180°, the folding force becomes stronger, the gluing margin strip 326*a* (326*b*) and the end portion of the corrugated fiberboard S1 (S2) are pressed to each other so as to come into close contact with each other, both end portions of the corrugated fiberboard S1 (S2) are joined to each other, and the corrugated carton B is formed. In addition, as shown in FIG. 1, the corrugated carton B is transported to the counter-ejector section 91.

In the counter-ejector section 91, the corrugated carton B is fed to the hopper device 92, the tip portion of the corrugated carton B in the transport direction D abuts on the front stopper, and the corrugated cartons B is stacked on the elevator 93 in a state of being arranged by the angle arrangement plate. In addition, if a predetermined number of corrugated cartons B are stacked on the elevator 93, the elevator 93 is lowered, a predetermined number of corrugated cartons B become one batch, are discharged by the ejection conveyor 94, and are fed to the post-process of the carton former 10.

Figure 2:
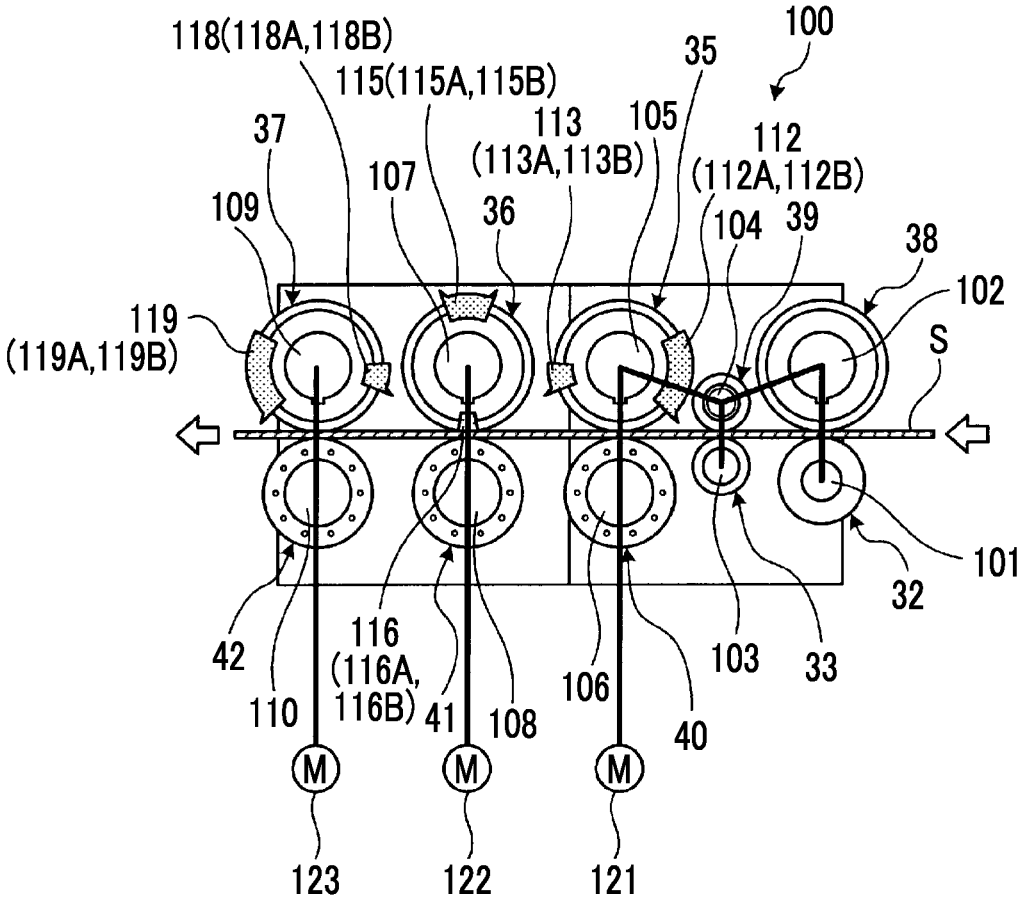
FIG. 2 is a schematic configuration view showing a slotter device of the present embodiment.

Here, the slotter creaser section 31 having the slotter device of the present embodiment will be described in detail. FIG. 2 is a schematic configuration view showing the slotter device of the present embodiment and FIG. 3 is a perspective view showing the slotter device.

Figure 3:
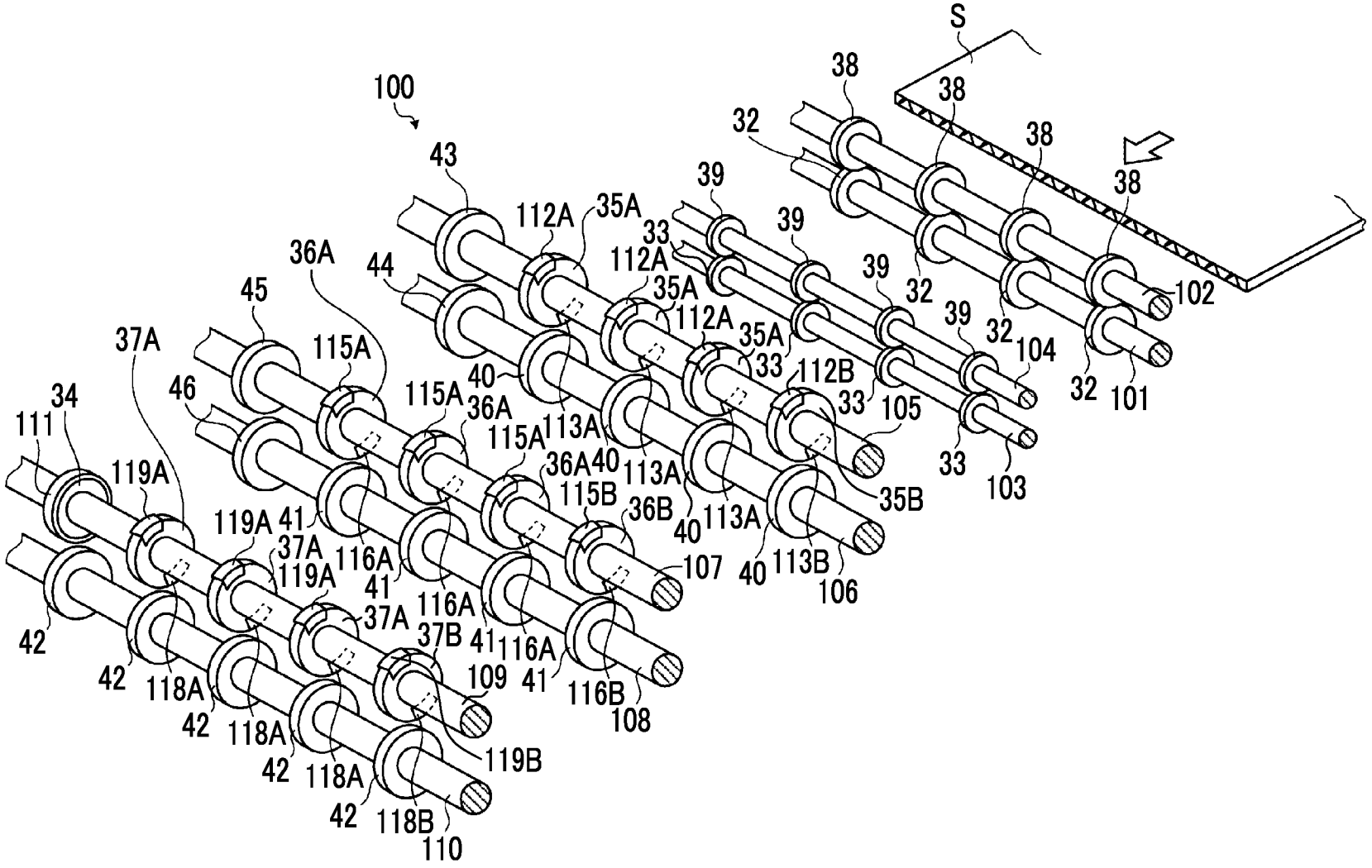
FIG. 3 is a perspective view showing the slotter device.

As shown in FIGS. 2 and 3, the slotter creaser section 31 includes the slotter device 100. The slotter device 100 performs creasing line processing, cutting, slicing, and gluing margin strip processing on the corrugated fiberboard S. The slotter device 100 is configured of the first creasing line rolls 32, the receiving rolls 38, the second creasing line rolls 33, the receiving rolls 39, the first slotter heads (first upper slotter heads) 35, the first lower blades (first lower slotter heads) 40, the second slotter heads (second upper slotter heads) 36, the second lower blades (second lower slotter heads) 41, the slitter head 34, the third slotter heads (third upper slotter head) 37, and the third lower blades (third lower slotter heads) 42.

In upper and lower roll shafts 101 and 102, each end portion is rotatably supported by a frame (not shown), the four first creasing line rolls 32 are fixed to the lower roll shaft 101 at predetermined intervals in an axial direction, and the four receiving rolls 38 are fixed to the upper roll shaft 102 at predetermined intervals in an axial direction. In addition, in upper and lower roll shafts 103 and 104, each end portion is rotatably supported by the frame (not shown), the four second creasing line rolls 33 are fixed to the lower roll shaft 103 at predetermined intervals in an axial direction, and the four receiving rolls 39 are fixed to the upper roll shaft 104 at predetermined intervals in an axial direction.

In this case, each first creasing line roll 32 and each receiving roll 38 are disposed to face each other vertically, and each second creasing line roll 33 and each receiving roll 39 are disposed to face each other vertically. In addition, each second creasing line roll 33 is disposed with a predetermined gap in a horizontal direction on the downstream of each first creasing line roll 32. The first creasing line rolls 32 and the second creasing line rolls 33 are disposed at the same position as each other in the axial directions of the roll shafts 101 and 103, and diameters of the second creasing line rolls 33 are set to be smaller than diameters of the first creasing line rolls 32.

Accordingly, the first creasing line rolls 32 and the receiving rolls 38 are disposed to face each other vertically, and if the corrugated fiberboard S enters portions between the first creasing line rolls 32 and the receiving rolls 38, the corrugated fiberboard S is interposed between the outer peripheral portions of the first creasing line rolls 32 and the outer peripheral portions of the receiving rolls 38, and creasing lines are formed on the lower surface of the corrugated fiberboard S when the corrugated fiberboard S passes through the portions between the outer peripheral portions of the first creasing line rolls 32 and the outer peripheral portions of the receiving rolls 38. In addition, the second creasing line rolls 33 and the receiving rolls 39 are disposed to face each other vertically, and if the corrugated fiberboard S enters portions between the second creasing line rolls 33 and the receiving rolls 39, the corrugated fiberboard S is interposed between the outer peripheral portions of the second creasing line rolls 33 and the outer peripheral portions of the receiving rolls 39, and creasing lines are formed on the lower surface of the corrugated fiberboard S again when the corrugated fiberboard S passes through the portions between the outer peripheral portions of the second creasing line rolls 33 and the outer peripheral portions of the receiving rolls 39. In this case, since the first creasing line roll 32 and the second creasing line roll 33 roll at the same position, one creasing line is formed on the corrugated fiberboard S.

Moreover, in upper and lower slotter shafts (rotating shafts) 105 and 106, each end portion is rotatably supported by the frame (not shown), the four first slotter heads 35 (35A and 35B) and one feed roller 43 are fixed to the upper slotter shaft 105 at predetermined intervals in an axial direction, and the four first lower blades 40 and one feed roller 44 are fixed to the lower slotter shaft 106 at predetermined intervals in an axial direction. In this case, the four first lower blades 40 are disposed to correspond to the four first slotter heads 35 vertically and the feed rollers 43 and 44 are disposed vertically. In addition, in upper and lower slotter shafts 107 and 108, each end portion is rotatably supported by the frame (not shown), the four second slotter heads 36 (36A and 36B) and one feed roller 45 are fixed to the upper slotter shaft 107 at predetermined intervals in an axial direction, and the four second lower blades 41 and one feed roller 46 are fixed to the lower slotter shaft 108 at predetermined intervals in an axial direction. In upper and lower slotter shafts 109 and 110, each end portion is rotatably supported by the frame (not shown), one slitter head 34 and the four third slotter heads (37A and 37B) are fixed to the upper slotter shaft 109 at predetermined intervals in an axial direction, and the five third lower blades 42 are fixed to the lower slotter shaft 110 at predetermined intervals in an axial direction.

A first slotter knife 112 (112A) and a second slotter knife 113 (113A) are mounted on the outer peripheral portion of each of the three first slotter heads 35A, and a first slotter knife 112 (112B) and a second slotter knife 113 (113B) are mounted on the outer peripheral portion of the one first slotter head 35B. A third slotter knife 115 (115A) and a fourth slotter knife 116 (116A) are mounted on the outer peripheral portion of each of the three second slotter heads 36A, and a third slotter knife 115 (115B) and a fourth slotter knife 116 (116B) are mounted on the outer peripheral portion of the one second slotter head 36B. A slitter knife 111 is mounted on the outer peripheral portion of one slitter head 34, a fifth slotter knife 118 (118A) and a sixth slotter knife 119 (119A) are mounted on the outer peripheral portion of each of the three third slotter heads 37A, and a fifth slotter knife 118 (118B) and a sixth slotter knife 119 (119B) are mounted on the outer peripheral portion of the one third slotter head 37B.

The slitter head 34 is used as a head for cutting an end portion which cuts one end portion of the corrugated fiberboard S in the width direction, and in FIG. 13, the slitter knife 111 can cut the end portions 321*a* and 321*b* at the cutting position 311. Returning to FIGS. 2 and 3, the slitter knife 111 is provided on the entire circumference of the slitter head 34.

The three first slotter heads 35A, the three second slotter heads 36A, and the three third slotter heads 37A are used for slicing to form grooves on the corrugated fiberboard S in the transport direction D, and in FIG. 13, can form the grooves 322*a*, 322*b*, 322*c*, 322*d*, 323*a*, 323*b*, 323*c*, 323*d*, 324*a*, 324*b*, 324*c*, and 324*d*. Returning to FIGS. 2 and 3, the first slotter knife 112A and the second slot knife 113A are provided on a portion of each of the first slotter heads 35A in the circumferential direction to be arranged in the circumferential direction. The third slotter knife 115A and the fourth slot knife 116A are provided on a portion of each of the second slotter heads 36A in the circumferential direction to be arranged in the circumferential direction. The fifth slotter knife 118A and the sixth slot knife 119A are provided on a portion of each of the third slotter heads 37A in the circumferential direction to be arranged in the circumferential direction.

The one first slotter head 35B, the one second slotter head 36B, and the one third slotter head 37B are disposed on the end portions of the slotter shafts 105, 107, and 109, are used for gluing margin strip processing by which the other end portion of the corrugated fiberboard S in the width direction is cut to form a gluing margin strip, and in FIG. 13, can cut the end portions 325*a*, 325*b*, 325*c*, and 325*d* to form the gluing margin strips 326*a* and 326*b*. Returning to FIGS. 2 and 3, the first slotter knife 112B and the second slot knife 113B are provided on a portion of the first slotter head 35B in the circumferential direction to be arranged in the circumferential direction. The third slotter knife 115B and the fourth slot knife 116B are provided on a portion of the second slotter head 36B in the circumferential direction to be arranged in the circumferential direction. The fifth slotter knife 118B and the sixth slot knife 119B are provided on a portion of the third slotter head 37B in the circumferential direction to be arranged in the circumferential direction.

Although not shown, each of the slotter knives 112B, 113B, 115B, 116B, 118B, and 119B is configured of a first cutting edge and a second cutting edge which are disposed in a direction approximately orthogonal to each other. The first cutting edge is mounted on each of the slotter heads 35B, 36B, and 37B in the transport direction of the corrugated fiberboard S, and the second cutting edge is mounted on each of the slotter heads 35B, 36B, and 37B in the width direction intersecting the transport direction of the corrugated fiberboard S. Accordingly, the first cutting edge and the second cutting edge are disposed to be formed in an L shape and cut the other end portion of the corrugated fiberboard S in the width direction into an L shape, and in FIG. 13, can cut the end portions 325*a*, 325*b*, 325*c*, and 325*d*.

In this case, the first slotter heads 35 (35A and 35B) and the first lower blades 40 are disposed so as to respectively face each other vertically, the second slotter heads 36 (36A and 36B) and the second lower blades 41 are disposed so as to respectively face each other vertically, and the slitter head 34 and the third slotter heads 37 (37A and 37B) and the third lower blades 42 are disposed so as to respectively face each other vertically. In addition, the first slotter heads 35 (35A and 35B) are disposed with predetermined gaps in the horizontal direction on the downstream sides of the second creasing line rolls 33, the second slotter heads 36 (36A and 36B) are disposed with predetermined gaps in the horizontal direction on the downstream sides of the first slotter heads 35 (35A and 35B), and the slitter head 34 and the third slotter heads 37 (37A and 37B) are disposed with predetermined gaps in the horizontal direction on the downstream sides of the second slotter heads 36 (36A and 36B). The second creasing line rolls 33 and the first slotter heads 35 (35A and 35B) are disposed at the same position as each other in the axial directions of the shafts 103 and 105, the first slotter heads 35 (35A and 35B) and the second slotter heads 36 (36A and 36B) are disposed at the same position as each other in the axial directions of the slotter shafts 105 and 107, and the second slotter heads 36 (36A and 36B) and the third slotter heads 37 (37A and 37B) are disposed at the same position as each other in the axial directions of the slotter shafts 107 and 109.

In addition, the roll shafts 101, 102, 103, and 104 and the slotter shafts 105 and 106 are drivingly connected to a first drive device 121, and the creasing line rolls 32 and 33, the receiving rolls 38 and 39, the first slotter heads 35, and the lower blades 40 can be drivingly rotated in synchronization with each other by the first drive device 121. In this case, the first drive device 121, the roll shafts 101, 102, 103, and 104, and the slotter shafts 105 and 106 are drivingly connected to each other by gears (not shown). The slotter shafts 107 and 108 are drivingly connected to a second drive device 122, and the second slotter heads 36 and the lower blades 41 can be drivingly rotated by the second drive device 122. The slotter shafts 109 and 110 are drivingly connected to a third drive device 123, and the third slotter heads 37 and the lower blades 42 can be drivingly rotated by the third drive device 123.

Each of the drive devices 121, 122, and 123 is connected to a motor driver (not shown) and the motor driver is connected to a control device. In addition, in the carton former 10, a position sensor which detects the position of the corrugated fiberboard S is provided in the sheet feeding section 11, and the control device controls the drive devices 121, 122, and 123 based on the detection results of the position sensor.

In the above descriptions, the slotter device 100 is configured of the first creasing line rolls 32, the receiving rolls 38, the second creasing line rolls 33, the receiving rolls 39, the slitter head 34, the first slotter heads 35, the first lower blades 40, the second slotter heads 36, the second lower blades 41, the third slotter heads 37, and the third lower blades 42. However, the slotter device 100 is not limited to this configuration.

Figure 4:
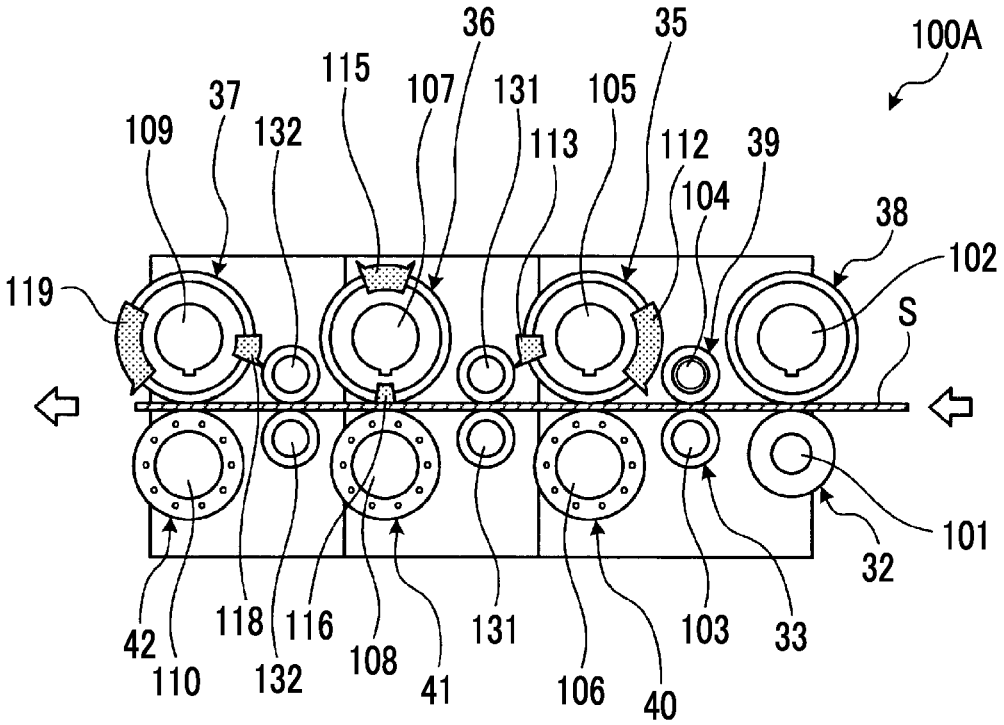
FIG. 4 is a schematic configuration view showing a modification example of the slotter device.

FIG. 4 is a schematic configuration view showing a modification example of the slotter device. As shown in FIG. 4, a slotter device 100A is configured of the first creasing line rolls 32, the receiving rolls 38, the second creasing line rolls 33, the receiving rolls 39, the first slotter heads 35, the first lower blades 40, a pair of upper and lower first feed pieces (transport unit) 131, the second slotter heads 36, the second lower blades 41, a pair of upper and lower second feed pieces (transport unit) 132, the slitter head 34, the third slotter heads 37, and the third lower blades 42.

Here, the slotter knives 112, 113, 115, 116, 118, and 119 mounted on the slotter heads 35, 36, and 37 will be described in detail.

As shown in FIG. 2, each of the slotter knives 112, 113, 115, 116, 118, and 119 are mounted on the outer peripheral portion of each of the slotter heads 35, 36, and 37, and each of outer edges of the slotter knives is formed in an arc shape. As shown in FIGS. 2 and 13, when the first slotter heads 35 rotate, the first slotter knives 112 form the grooves 322*d*, 323*d*, 324*d*, which are opening grooves, on the upstream end portion of the corrugated fiberboard S in the transport direction D, and cut the end portion 325*d*. In addition, when the third slotter heads 37 rotate, the sixth slotter knives 119 form the grooves 322*a*, 323*a*, 324*a*, which are opening grooves, on the downstream end portion of the corrugated fiberboard S in the transport direction D, and cut the end portion 325*a*. When the first, second, and third slotter heads 35, 36, and 37 rotate, at least two slotter knives of the second slotter knife 113, the third slotter knife 115, the fourth slotter knife 116, and the fifth slotter knife 118 form communication grooves 322, 323, and 324 (grooves 322*b*, 322*c*, 323*b*, 323*c*, 324*b*, and 324*c*) at the intermediate portion of the corrugated fiberboard S in the transport direction D, and cut the end portions 325*b* and 325*c*.

Accordingly, as shown in FIG. 2, in the first slotter head 35, the circumferential length of the first slotter knife 112 is set to be longer than the circumferential length of the second slotter knife 113. In the third slotter head 37, the circumferential length of the sixth slotter knife 119 is set to be longer than the circumferential length of the fifth slotter knife 118. Here, the circumferential length of the first slotter knife 112 and the circumferential length of the sixth slotter knife 119 are set to be the same as each other, and the circumferential length of the second slotter knife 113 and the circumferential length of the fifth slotter knife 118 are set to be the same as each other.

In the second slotter head 36, the circumferential length of the third slotter knife 115 is set to be longer than the circumferential length of the fourth slotter knife 116. The circumferential length of each of the second slotter knife 113 and the fifth slotter knife 118 is set to be shorter than the circumferential length of the third slotter knife 115 and is set to be longer than the circumferential length of the fourth slotter knife 116.

The second slotter knife 113 is fixed to the outer peripheral portion of the first slotter head 35, the third slotter knife 115 is fixed to the outer peripheral portion of the second slotter head 36, and the sixth slotter knife 119 is fixed to the outer peripheral portion of the third slotter head 37. Meanwhile, the first slotter knife 112 is mounted on the outer peripheral portion of the first slotter head 35 so as to be adjustable in position in the circumferential direction, the fourth slotter knife 116 is mounted on the outer peripheral portion of the second slotter head 36 so as to be adjustable in position in the circumferential direction, and the fifth slotter knife 118 is mounted on the outer peripheral portion of the third slotter head 37 so as to be adjustable in position in the circumferential direction. Here, the fixing is performed by bolt-fastening, welding, or the like and the position being adjustable means that the position is freely movable in the circumferential direction by a rail or an elongated hole.

Hereinafter, slicing with respect to the corrugated fiberboard S performed by the slotter device 100 of the present embodiment will be described. In addition, in descriptions below, a portion of the corrugated fiberboard S is shown and described.

Figure 5:
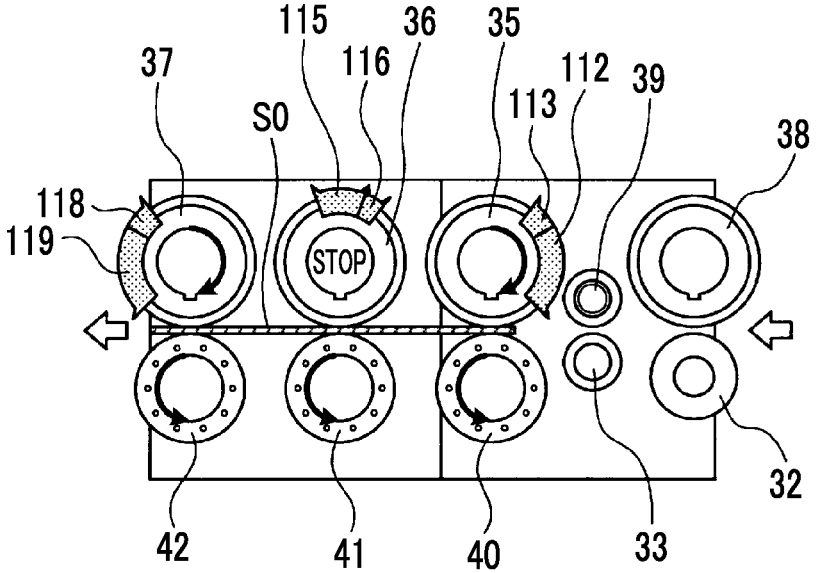
FIG. 5 is a schematic view of the slotter device showing an arrangement of slotter knives when a single box sheet is processed.

First, slicing of a single box sheet performed by the slotter device 100 will be described. FIG. 5 is a schematic view of the slotter device showing an arrangement of slotter knives when the single box sheet is processed and FIG. 6 is a plan view showing the single box sheet.

As shown in FIG. 5, in a case where slicing is performed on a single box sheet (corrugated fiberboard) S0, the position is adjusted such that the first slotter knife 112 comes into contact with the fixed second slotter knife 113 in the first slotter head 35, the position is adjusted such that the fourth slotter knife 116 comes into contact with the fixed third slotter knife 115 in the second slotter head 36, and the position is adjusted such that the fifth slotter knife 118 comes into contact with the fixed sixth slotter knife 119 in the third slotter head 37. In addition, the drive of the second slotter head 36 is stopped while the first slotter head 35 and the third slotter head 37 drivingly rotate.

Figure 6:
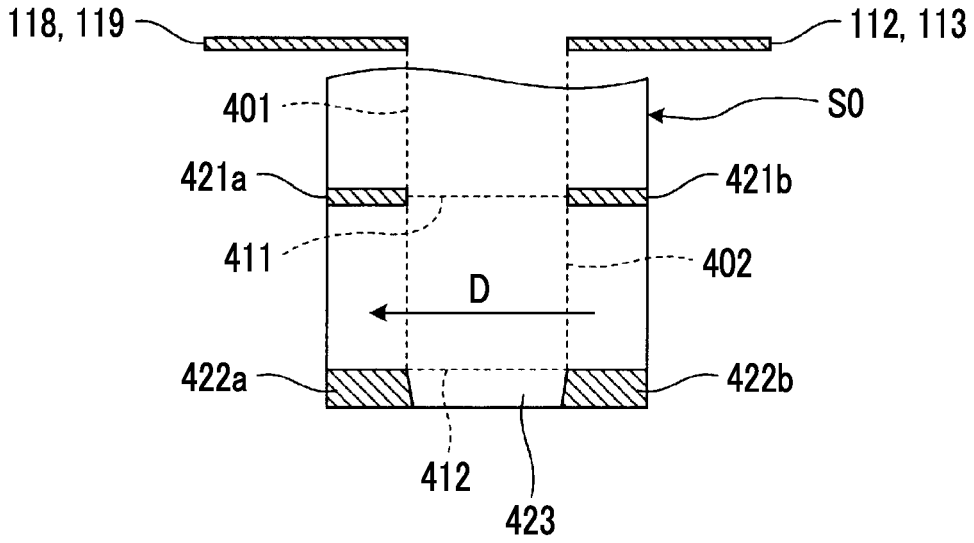
FIG. 6 is a plan view showing the single box sheet.

As shown in FIGS. 5 and 6, folding lines 401 and 402 are formed on the corrugated fiberboard (single box sheet) S0 in the pre-process. First, when the corrugated fiberboard S0 passes through the first creasing line rolls 32, creasing lines 411 and 412 are formed, and when corrugate fiberboard S0 passes through the second creasing line rolls 33, the creasing lines 411 and 412 are formed again. Newt, when the corrugated fiberboard S0 passes through the first slotter head 35A, a groove 421*b* is formed at the position of the creasing line 411 by the first slotter knife 112A (second slotter knife 113A). When the corrugated fiberboard S0 passes through the first slotter head 35B, an end portion 422*b* is cut at the position of the creasing line 412 by the first slotter knife 112B (second slotter knife 113B). When the corrugated fiberboard S0 passes through the third slotter head 37A after passing through the stopped second slotter head 36, a groove 421*a* is formed at the position of the creasing line 411 by the sixth slotter knife 119A (fifth slotter knife 118A). When the corrugated fiberboard S0 passes through the third slotter head 37B, an end portion 422*a* is cut at the position of the creasing line 412 by the sixth slotter knife 119B (fifth slotter knife 118B), and a gluing margin strip 423 is formed. When the corrugated fiberboard S0 passes through the slitter head 34 (refer to FIG. 3), the end portion is cut at the cutting position.

In the case where the slicing is performed on the corrugated fiberboard S0 of the single box sheet, skip feed processing can be performed. This skip feed processing is applied to slicing with respect to a corrugated fiberboard S0 having a relatively larger size in the transport direction than a general corrugated fiberboard. That is, as shown in FIG. 1, in the sheet feeding section 11, when the corrugated fiberboard S stacked on the table 12 is fed, the corrugated fiberboard S is fed every other time with respect to the feeding timing of a general corrugated fiberboard S. In general, the sheet feeding section 11 feeds one corrugated fiberboard S with respect to one rotation of the printing cylinder 22 in the printing section 21. However, in the skip feed processing, the sheet feeding section 11 feeds one corrugated fiberboard S with respect to two rotations of the printing cylinder 22 in the printing section 21. As a result, even when the corrugated fiberboard S having a long size in the transport direction is provided, the corrugated fiberboard S can be appropriately transported while the end portions of the front and rear corrugated fiberboards S do not come into contact with each other.

When the skip feed processing is performed on the corrugated fiberboard S0 of the single box sheet, as shown in FIGS. 5 and 6, the drive of the second slotter head 36 is stopped while the first slotter head 35 and the third slotter head 37 are drivingly rotated, grooves 421*a* and 421*b* can be formed at the position of the creasing line 411 by the first slotter knife 112, the second slotter knife 113, the fifth slotter knife 118, and the sixth slotter knife 119, and the end portions 422*a* and 422*b* are cut at the position of the creasing line 412 to form the gluing margin strip 423.

Figure 7:
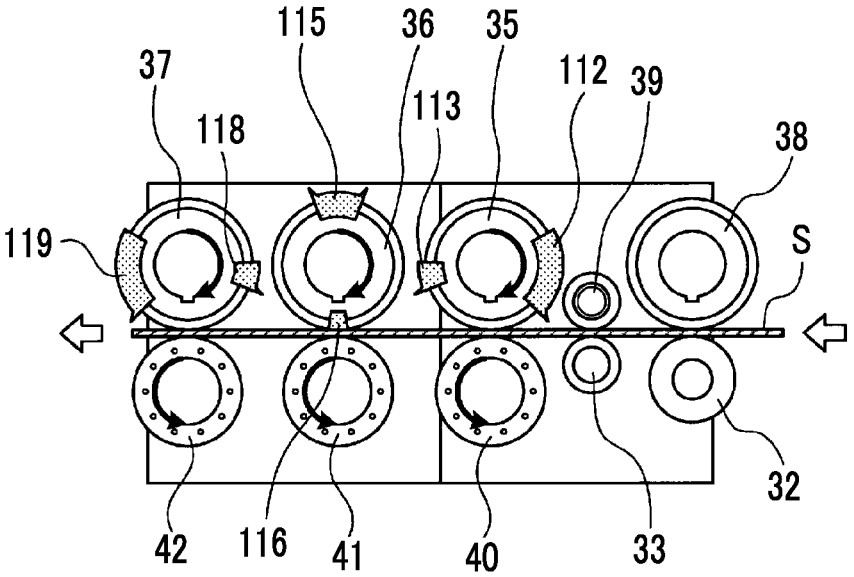
FIG. 7 is a schematic view of the slotter device showing an arrangement of slotter knives when a twin box sheet is processed.
Figure 9:
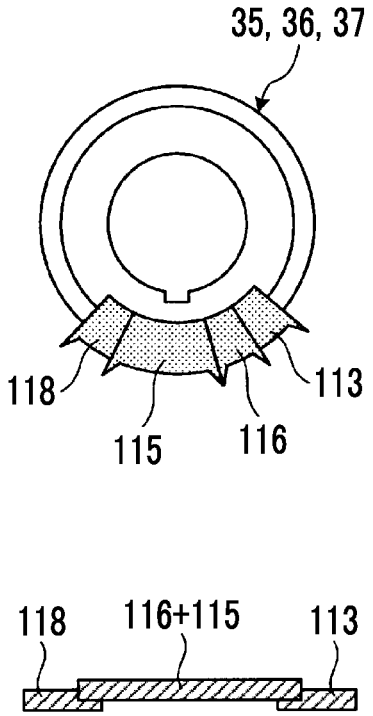
FIG. 9 is a schematic view for explaining phases of several slotter knives so as to process a communication groove.
Figure 10:
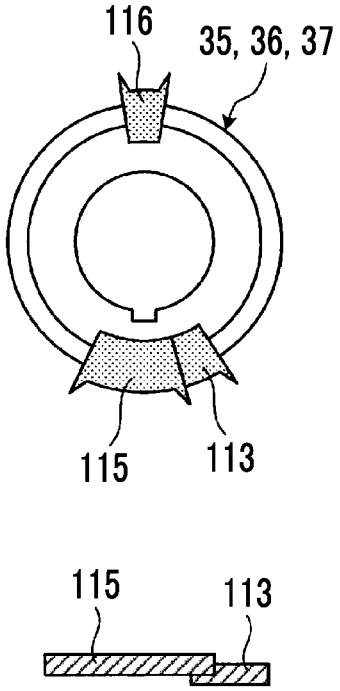
FIG. 10 is a schematic view for explaining phases of several slotter knives so as to process another communication groove.
Figure 11:
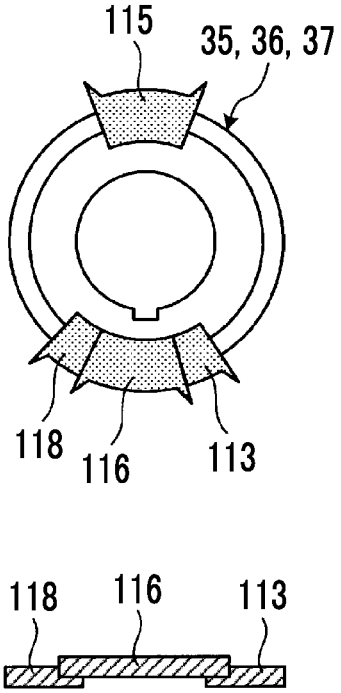
FIG. 11 is a schematic view for explaining phases of several slotter knives so as to process still another communication groove.

Next, slicing with respect to the twin box sheet performed by the slotter device 100 will be described. FIG. 7 is a schematic view of the slotter device showing an arrangement of slotter knives when the twin box sheet is processed, FIG. 8 is a plan view showing the twin box sheet, FIG. 9 is a schematic view for explaining phases of several slotter knives so as to process, a communication groove, FIG. 10 is a schematic view for explaining phases of several slotter knives so as to process another communication groove, and FIG. 11 is a schematic view for explaining phases of several slotter knives so as to process another communication groove.

As shown in FIG. 7, in a case where slicing is performed on the twin box sheet (corrugated fiberboard) S having a relatively long length (groove length) in the transport direction, the first slotter knife 112 is adjusted to be positioned at a predetermined position with respect to the fixed second slotter knife 113 in the first slotter head 35, the fourth slotter knife 116 is adjusted to be positioned at a predetermined position with respect to the fixed third slotter knife 115 in the second slotter head 36, and the fifth slotter knife 118 is adjusted to be positioned at a predetermined position with respect to the fixed sixth slotter knife 119 in the third slotter head 37. The first slotter head 35, the second slotter head 36, and the third slotter head 37 are drivingly rotated.

Figure 8:
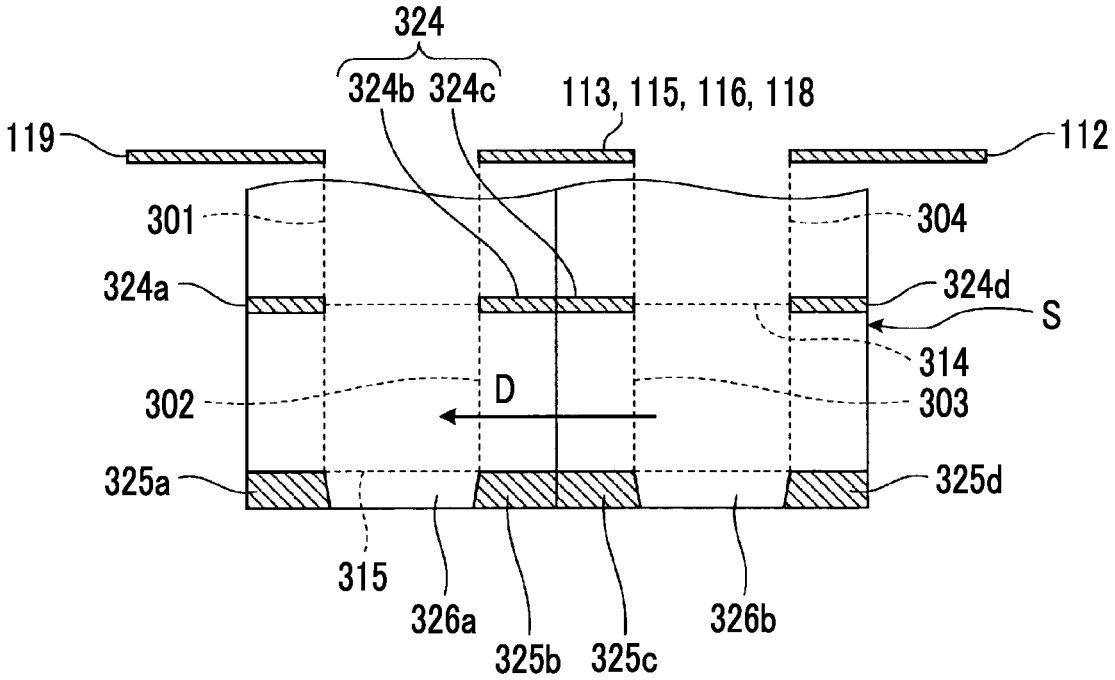
FIG. 8 is a plan view showing the twin box sheet.

As shown in FIGS. 7 and 8, folding lines 301, 302, 303, and 304 are formed on the corrugated fiberboard (twin box sheet) S in the pre-process. First, the creasing lines 314 and 315 are formed when the corrugated fiberboard S passes through the first creasing line roll 32, and the creasing lines 314 and 315 are formed again when the corrugated fiberboard S passes through the second creasing line roll 33. Next, when the corrugated fiberboard S passes through the first slotter head 35A, the groove 324*d* is formed at the position of the creasing line 314 by the first slotter knife 112A and a portion of the groove 324*c* is formed at the position of the creasing line 314 by the second slotter knife 113A. Moreover, when the corrugated fiberboard S passes through the slotter head 35B, the end portion 325*d* is cut at the position of the creasing line 315 by the first slotter knife 112B and a portion of the end portion 325*c* is cut by the second slotter knife 113B to form the gluing margin strip 326*b*.

Continuously, when the corrugated fiberboard S passes through the second slotter head 36A, a portion of the grooves 324*b* and 324*c* is formed at the position of the creasing line 314 by the third slotter knife 115A and the fourth slotter knife 116A. In addition, when the corrugated fiberboard S passes through the second slotter head 36B, a portion of the end portions 325*b* and 325*c* is formed at the position of the creasing line 315 by the third slotter knife 115B and the fourth slotter knife 116B. Finally, when the corrugated fiberboard S passes through the third slotter head 37A, the grooves 324*b* and 324*c* are completely formed at the position of the creasing line 314 by the fifth slotter knife 118A and the groove 324*a* is formed at the position of the creasing line 314 by the sixth slotter knife 119B. Moreover, when the corrugated fiberboard S passes through the slotter head 37B, the end portions 325*b* and 325*c* are completely cut at the position of the creasing line 315 by the fifth slotter knife 118B and the end portion 325*a* is cut by the sixth slotter knife 119B to form the gluing margin strip 326*a*. When the corrugated fiberboard S passes through the slitter head 34 (refer to FIG. 3), the end portion is cut at the cutting position.

That is, as shown in FIG. 9, since rotation phases of the four slotter knives 113, 115, 116, and 118 are continued so as to partially overlap each other with respect to the corrugated fiberboard S at the positions of the slotter heads 35, 36, and 37, by cutting the grooves 324*b* and 324*c* stepwise, finally, it is possible to form the communication groove 324, and it is possible to cut the end portions 325*b* and 325*c* stepwise. In addition, in the above-descriptions, since the corrugated fiberboard S passes through the first slotter head 35, the second slotter head 36, and the third slotter head 37 in this order, the processing positions are described in order of the slotter head 35, 36, and 37. However, in actual, the slotter heads 35, 36, and 37 approximately simultaneously performs cutting on the corrugated fiberboard S.

In addition, in a case where the grooves 324*a*, 324*b*, 324*c*, and 324*d* are formed on the corrugated fiberboard S to cut the end portions 325*a*, 325*b*, 325*c*, and 325*d*, combinations of the slotter knives which form the grooves 324*b* and 324*c* to cut the end portions 325*b* and 325*c* are not limited to the above-described combinations. For example, in a case where slicing is performed on the twin box sheet (corrugated fiberboard) S having a relatively short length (groove length) in the transport direction, as shown in FIG. 10, the grooves 324*b* and 324*c* are formed on the corrugated fiberboard S and the end portions 325*b* and 325*c* are cut using the second slotter knife 113 and the third slotter knife 115. That is, since the rotation phases of the two slotter knives 113 and 115 is continued so as to partially overlap each other with respect to the corrugated fiberboard S at the positions of the slotter heads 35, 36, and 37, by cutting the grooves 324*b* and 324*c* stepwise, finally, it is possible to form the communication groove 324, and it is possible to cut the end portions 325*b* and 325*c* stepwise.

Moreover, in a case where slicing is performed on the twin box sheet (corrugated fiberboard) S, as shown in FIG. 11, the grooves 324*b* and 324*c* are formed on the corrugated fiberboard S and the end portions 325*b* and 325*c* are cut using the second slotter knife 113, the fourth slotter knife 116, and the fifth slotter knife 118. That is, since the rotation phases of the three slotter knives 113, 116, 118 is continued so as to partially overlap each other with respect to the corrugated fiberboard S at the positions of the slotter heads 35, 36, and 37, by cutting the grooves 324*b* and 324*c* stepwise, finally, it is possible to form the communication groove 324, and it is possible to cut the end portions 325*b* and 325*c* stepwise.

Figure 12:
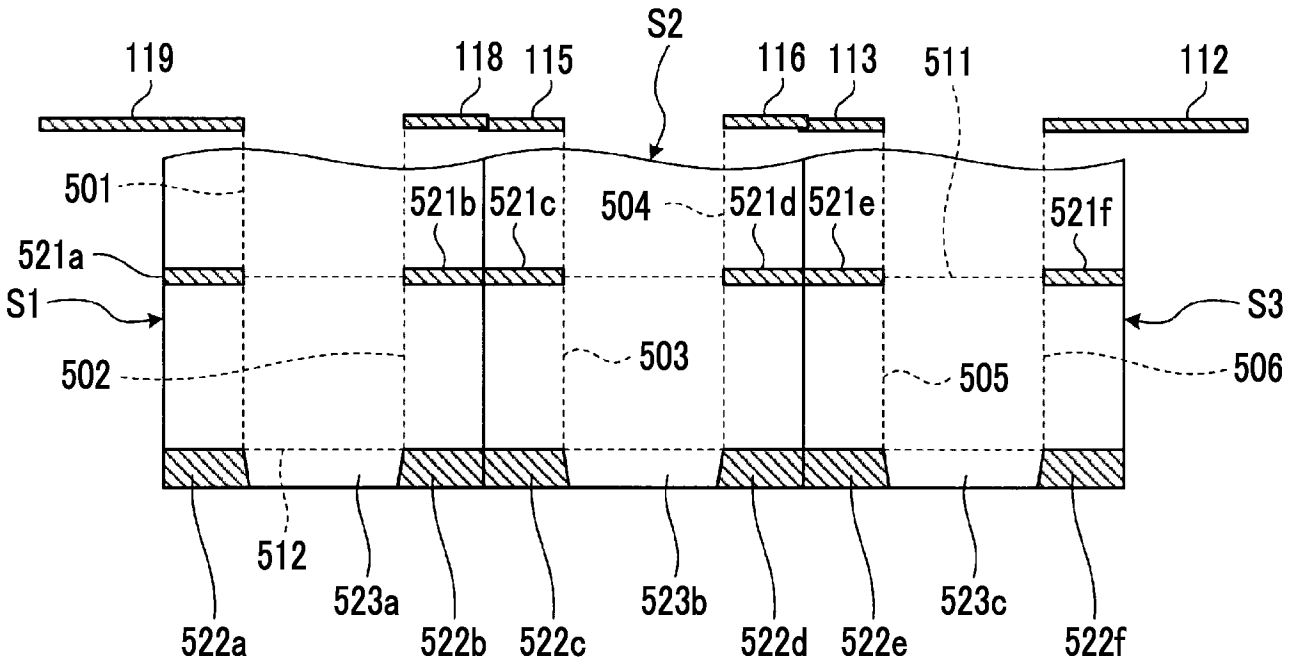
FIG. 12 is a schematic view of the slotter device showing an arrangement of slotter knives when a triple box sheet is processed.

Finally, slicing with respect to a triple box sheet performed by the slotter device 100 will be described. FIG. 12 is a schematic view of the slotter device showing an arrangement of slotter knives when the triple box sheet is processed.

As shown in FIG. 7, similarly to the twin box sheet, in a case where slicing is performed on the triple box sheet (corrugated fiberboard) S, the slotter knives 112, 116, and 118 are adjusted to be positioned at predetermined positions with respect to the fixed slotter knives 113, 115, and 119 in the slotter heads 35, 36, and 37. In addition, the first slotter head 35, the second slotter head 36, and the third slotter head 37 are drivingly rotated.

As shown in FIGS. 7 and 12, folding lines 501, 502, 503, 504, 505, and 506 are formed on the corrugated fiberboard (triple box sheet) S (S1, S2, and S3) in the pre-process. First, the creasing lines 511 and 512 are formed when the corrugated fiberboard S passes through the first creasing line roll 32, and the creasing lines 511 and 512 are formed again when the corrugated fiberboard S passes through the second creasing line roll 33. Next, when the corrugated fiberboard S passes through the first slotter head 35A, the groove 521*f* is formed at the position of the creasing line 511 by the first slotter knife 112A and grooves 521*d* and 521*e* are partially formed at the position of the creasing line 511 by the second slotter knife 113A. Moreover, when the corrugated fiberboard S passes through the first slotter head 35B, an end portion 522*f* is cut at the position of the creasing line 512 by the first slotter knife 112B and end portions 522*d* and 522*e* are partially cut by the second slotter knife 113B to form a gluing margin strip 523*c*.

Continuously, when the corrugated fiberboard S passes through the second slotter head 36A, the grooves 521*d* and 521*e* are completely formed at the position of the creasing line 511 by the fourth slotter knife 116A and the grooves 521*b* and 521*c* are partially formed at the position of the creasing line 511 by the third slotter knife 115A. In addition, when the corrugated fiberboard S passes through the second slotter head 36B, the end portions 522*d* and 522*e* are completely cut at the position of the creasing line 512 by the fourth slotter knife 116B and the end portions 522*b* and 522*c* are partially cut by the third slotter knife 115B to form a gluing margin strip 523*b*. Finally, when the corrugated fiberboard S passes through the third slotter head 37A, the grooves 521*b* and 521*c* are completely formed at the position of the creasing line 511 by the fifth slotter knife 118A and a groove 521*a* is formed at the position of the creasing line 511 by the sixth slotter knife 119A. Moreover, when the corrugated fiberboard S passes through the third slotter head 37B, the end portions 522*b* and 522*c* are completely cut at the position of the creasing line 512 by the fifth slotter knife 118B and the end portion 522*a* is cut by the sixth slotter knife 119B to form a gluing margin strip 523*a*. When the corrugated fiberboard S passes through the slitter head 34 (refer to FIG. 3), the end portion is cut at the cutting position.

In this way, in the slotter device of the present embodiment, the first slotter head 35, the first lower blade 40, the first slotter knife 112 and the second slotter knife 113 mounted on the outer peripheral portion of the first slotter head 35, the second slotter head 36, the second lower blade 41, the third slotter knife 115 and the fourth slotter knife 116 mounted on the outer peripheral portion of the second slotter head 36, the third slotter head 37, the third lower blade 42, and the fifth slotter knife 118 and the sixth slotter knife 119 mounted on the outer peripheral portion of the third slotter head 37 are provided.

Accordingly, when the corrugated fiberboards S1 and S2 having several sheets connected to each other in the length in the transport direction are manufactured, it is possible to perform slicing or gluing margin strip processing, and in this case, it is possible to easily adjust the lengths of grooves or gluing margin strips to be processed by combining the several slotter knives 112, 113, 115, 116, 118, and 119, the grooves or gluing margin strips having lengths different from each other can be processed, and it is possible to improve versatility.

In the slotter device of the present embodiment, the first slotter knife 112 and the sixth slotter knife 119 can form an opening groove on each end portion of the corrugated fiberboard S in a transport direction, and the second slotter knife 113, the third slotter knife 115, the fourth slotter knife 116, and the fifth slotter knife 118 can form a communication groove on an intermediate portion of the corrugated fiberboard S in the transport direction. Accordingly, it is possible to easily form the grooves or the gluing margin strips having lengths different from each other by selecting a slotter knife to be used among the second, third, fourth, and fifth slotter knives 113, 115, 116, and 118.

In the slotter device of the present embodiment, the circumferential length of each of the first slotter knife 112 and the sixth slotter knife 119 is set to be longer than a circumferential length of each of the second slotter knife 113 and the fifth slotter knife 118. Accordingly, it is possible to form an opening groove having a predetermined length on each end portion of the corrugated fiberboard S using only the first and sixth slotter knives 112 and 119 by lengthening the circumferential lengths of the first and sixth slotter knives 112 and 119, and by shortening the circumferential lengths of the second and fifth slotter knives 113 and 118, it is possible to form the communication groove having a desired length by combining the four slotter knives 113, 115, 116, and 118.

In the slotter device of the present embodiment, a circumferential length of the third slotter knife 115 is set to be longer than a circumferential length of the fourth slotter knife 116. Accordingly, it is possible to easily form the communication groove having a desired length by providing the slotter knives 115 and 116 having the circumferential lengths different from each other on the second slotter head 36.

In the slotter device of the present embodiment, the circumferential length of each of the second slotter knife 113 and the fifth slotter knife 118 is set to be shorter than the circumferential length of the third slotter knife 115 and to be longer than the circumferential length of the fourth slotter knife 116. Accordingly, by setting the circumferential lengths of the second, third, fourth, and fifth slotter knives 113, 115, 116, and 118 to be different from each other, it is possible to easily form the communication groove having a desired length by combining the four slotter knives 113, 115, 116, and 118.

In the slotter device of the present embodiment, the second slotter knife 113, the third slotter knife 115, and the sixth slotter knife 119 are respectively fixed to the slotter heads 35, 36, and 37, and the first slotter knife 112, the fourth slotter knife 116, and the fifth slotter knife 118 are respectively mounted on the slotter heads 35, 36, and 37 so as to be adjustable in position in a circumferential direction. Accordingly, it is possible to easily adjust the circumferential lengths of the several combined slotter knives 112, 113, 115, 116, 118, and 119 by moving other slotter knives 112, 116, and 118 based on the fixed slotter knives 113, 115, and 119.

In the slotter device of the present embodiment, the slotter heads 35, 36, and 37 are connected to drive devices 121, 122, and 123 which are driving rotated individually. Accordingly, it is possible to easily form the communication groove having a desired length by stopping the second slotter head 36 on which unused slotter knives 115 and 116 are mounted.

In the slotter device of the present embodiment, the first and second feed pieces 131 and 132 are provided between the first slotter head 35, the second slotter head 36, and the third slotter head 37. Accordingly, even when the corrugated fiberboard S which is short in the transport direction is provided, it is possible to appropriately transport the corrugated fiberboard S so as to process the corrugated fiberboard S, and it is possible to improve reliability.

In addition, the sheet slicing method of the present embodiment includes: a step of forming a first opening groove on the end portion on the downstream side in the transport direction of the corrugated fiberboard S by the first slotter knife 112 mounted on the first slotter head 35, a step of forming a communication groove on the intermediate portion of the corrugated fiberboard S in the transport direction by at least two slotter knives of the second slotter knife 113 mounted on the first slotter head 35, the third slotter knife 115 and the fourth slotter knife 116 mounted on the second slotter head 36, and the fifth slotter knife 118 mounted on the third slotter head 37, and a step of forming a second opening groove on the end portion on the upstream side in the transport direction of the corrugated fiberboard S by the sixth slotter knife 119 mounted on the third slotter head 37.

Accordingly, it is possible to easily adjust the lengths of grooves or gluing margin strips to be processed by combining the several slotter knives 112, 113, 115, 116, 118 and 119, cut portions having lengths different from each other can be processed, and it is possible to improve versatility.

In the sheet slicing method of the present embodiment, when slicing is performed on the corrugated fiberboard S0 having one sheet, the second slotter head 36 is stopped, the first opening groove is formed by at least one of the slotter knives 112 and 113 of the first slotter head 35, and the second opening groove is formed by at least one of the slotter knives 118 and 119 of the third slotter head 37. Accordingly, even when the corrugated fiberboard S0 having one sheet is provided, it is possible to easily form the communication groove having a desired length by stopping the unused second slotter head 36.

Moreover, in the carton former of the present embodiment, the sheet feeding section 11, the printing section 21, the slotter creaser section 31, the die-cut section 51, the cutting section 61, the speed-increasing section 71, the folding section 81, and the counter-ejector section 91 are provided, and the slotter device 10 is provided in the slotter creaser section 31. Accordingly, it is possible to easily adjust the lengths of the grooves or the gluing margin strips to be processed by combining the several slotter knives 112, 113, 115, 116, 118, and 119, it is possible to process the grooves or the gluing margin strips having lengths different from each other, and thereby, it is possible to improve versatility.

In addition, the circumferential lengths of the slotter knives 112, 113, 115, 116, 118, and 119 described in the above-described embodiment are not limited to the embodiment, and the circumferential lengths may be appropriately set according to the size, the shape, or the like of the corrugated fiberboard S to be processed.

In addition, in the above-described embodiment, the carton former 10 is configured of the sheet feeding section 11, the printing section 21, the slotter creaser section 31, the die-cut section 51, the cutting section 61, the speed-increasing section 71, the folding section 81, and the counter-ejector section 91. However, in a case where the hand hole is not required in the corrugated fiberboard S, the die-cut section 51 may not be omitted. In addition, the carton former 10 may be configured of the sheet feeding section 11, the printing section 21, and the slotter creaser section 31. Moreover, in the carton former 10, the cutting section 61 or the speed-increasing section 71 may be omitted, and the corrugated fiberboard S may be cut in a post-process in which the corrugated fiberboard S is discharged from the carton former 10.

The invention claimed is:

1. A slotter device comprising:

a first upper slotter head and a first lower slotter head which are supported so as to be rotatable relative to each other and perform slicing of a sheet;

a first slotter knife and a second slotter knife which are mounted on an outer peripheral portion of any one of the first upper slotter head and the first lower slotter head;

a second upper slotter head and a second lower slotter head which are disposed on a downstream sides of the first upper slotter head and the first lower slotter head in a transport direction of the sheet and supported so as to be rotatable relative to each other and perform the slicing of the sheet;

a third slotter knife and a fourth slotter knife which are mounted on an outer peripheral portion of any one of the second upper slotter head and the second lower slotter head;

a third upper slotter head and a third lower slotter head which are disposed on a downstream sides of the second upper slotter head and the second lower slotter head in the transport direction of the sheet and supported so as to be rotatable relative to each other and perform the slicing of the sheet; and a fifth slotter knife and a sixth slotter knife which are mounted on an outer peripheral portion of any one of the third upper slotter head and the third lower slotter head, wherein the first slotter knife and the sixth slotter knife can form an opening groove on each end portion of the sheet in a transport direction, and the second slotter knife, the third slotter knife, the fourth slotter knife, and the fifth slotter knife can form a communication groove on an intermediate portion of the sheet in the transport direction, the second slotter knife is fixed to one of the first upper slotter head and the first lower slotter head, the third slotter knife is fixed to one of the second upper slotter head and the second lower slotter head, the sixth slotter knife is fixed to one of the third upper slotter head and the third lower slotter head, the first slotter knife is mounted on one of the first upper slotter head and the first lower slotter head so as to be adjustable in position in a circumferential direction, the fourth slotter knife is mounted on one of the second upper slotter head and the second lower slotter head so as to be adjustable in position in a circumferential direction, the fifth slotter knife is mounted on one of the third upper slotter head and the third lower slotter head so as to be adjustable in position in a circumferential direction, a length of the communication groove is adjusted by adjusting the position of the fourth slotter knife in the circumferential direction on one of the second upper slotter head and the second lower slotter head and the position of the fifth slotter knife in the circumferential direction on one of the third upper slotter head and the third lower slotter head in such a manner that the rotation phases of the plurality of slotter knives selectively used from among the second slotter knife, the third slotter knife, the fourth slotter knife, and the fifth slotter knife partially overlap each other, and a circumferential length of each of the first slotter knife and the sixth slotter knife is set to be longer than a circumferential length of each of the second slotter knife and the fifth slotter knife.

2. The slotter device according to claim 1, wherein a circumferential length of the third slotter knife is set to be longer than a circumferential length of the fourth slotter knife.

3. The slotter device according to claim 2, wherein the circumferential length of each of the second slotter knife and the fifth slotter knife is set to be shorter than the circumferential length of the third slotter knife and to be longer than the circumferential length of the fourth slotter knife.

4. The slotter device according to claim 1, wherein a first drive device individually rotating one of the first upper slotter head and the first lower slotter head is connected to the one of the first upper slotter head and the first lower slotter head on which the first slotter knife and the second slotter knife are mounted, a second drive device individually rotating one of the second upper slotter head and the second lower slotter head is connected to the one of the second upper slotter head and the second lower slotter head on which the third slotter knife and the fourth slotter knife are mounted, and a third drive device individually rotating one of the third upper slotter head and the third lower slotter head is connected to the one of the third upper slotter head and the third lower slotter head on which the fifth slotter knife and the sixth slotter knife are mounted.

5. The slotter device according to claim 1, wherein a first transport unit is provided between a first unit including the first upper slotter head and the first lower slotter head and a second unit including the second upper slotter head and the second lower slotter head, and a second transport unit is provided between the second unit and a third unit including the third upper slotter head and the third lower slotter head.

6. A carton former comprising:

a sheet feeding section which supplies a sheet;

a printing section which performs printing on the sheet;

a slotter creaser section having the slotter device according to claim 1 which performs creasing line processing and slicing on the printed sheet;

a cutting section which cuts the sheet subjected to the creasing line processing and the slicing at an intermediate position of the sheet in a transport direction;

a folding section which folds the cut sheet and joins an end portion of the sheet to form a carton body; and a counter-ejector section which stacks the carton bodies while counting the carton bodies, and thereafter, discharges the carton bodies for each predetermined number.

7. A sheet slicing method of performing slicing of a corrugated fiberboard by a first slotter head, a second slotter head, and a third slotter head aligned in a transport direction of the corrugated fiberboard in a state where several corrugated fiberboards are connected to each other in the transport direction wherein the first slotter head is provided with a second slotter knife, the second slotter head is provided with a third slotter knife and fourth slotter knife, and the third slotter head is provided with a fifth slotter knife, the method comprising:

a step of forming a first opening groove on one end portion of the corrugated fiberboard in the transport direction by a first slotter knife mounted on the first slotter head;

a step of forming a communication groove on an intermediate portion of the corrugated fiberboard in the transport direction by at least two slotter knives of the second slotter knife, a third slotter knife, a fourth slotter knife, and a fifth slotter knife; and a step of forming a second opening groove on the other end portion of the corrugated fiberboard in the transport direction by a sixth slotter knife mounted on the third slotter head, wherein the second slotter knife is fixed to one of the first upper slotter head and the first lower slotter head, the third slotter knife is fixed to one of the second upper slotter head and the second lower slotter head, the sixth slotter knife is fixed to one of the third upper slotter head and the third lower slotter head, the first slotter knife is mounted on one of the first upper slotter head and the first lower slotter head so as to be adjustable in position in a circumferential direction, the fourth slotter knife is mounted on one of the second upper slotter head and the second lower slotter head so as to be adjustable in position in a circumferential direction, the fifth slotter knife is mounted on one of the third upper slotter head and the third lower slotter head so as to be adjustable in position in a circumferential direction, the step of forming the communication groove adjusts a length of the communication groove by adjusting the position of the fourth slotter knife in the circumferential direction on one of the second upper slotter head and the second lower slotter head and the position of the fifth slotter knife in the circumferential direction on one of the third upper slotter head and the third lower slotter head in such a manner that the rotation phases of the plurality of slotter knives selectively used from among the second slotter knife, the third slotter knife, the fourth slotter knife, and the fifth slotter knife partially overlap each other, and a circumferential length of each of the first slotter knife and the sixth slotter knife is set to be longer than a circumferential length of each of the second slotter knife and the fifth slotter knife.

8. The sheet slicing method according to claim 7, wherein when slicing is performed on the corrugated fiberboard having one sheet, the second slotter head is stopped, the first opening groove is formed by at least one slotter knife of the first slotter head, and the second opening groove is formed by at least one slotter knife of the third slotter head.

* * * * *